US012808578B2

(12) United States Patent
Yuasa et al.

(10) Patent No.: US 12,808,578 B2
(45) Date of Patent: Nov. 24, 2026

(54) WATER HEATER

(71) Applicant: RINNAI CORPORATION, Nagoya (JP)

(72) Inventors: Naoki Yuasa, Nagoya (JP); Toru Teraguchi, Nagoya (JP)

(73) Assignee: RINNAI CORPORATION, Nagoya (JP)

( * ) Notice: Subject to any disclaimer, the term of this patent is extended or adjusted under 35 U.S.C. 154(b) by 355 days.

(21) Appl. No.: 18/728,133

(22) PCT Filed: Sep. 12, 2022

(86) PCT No.: PCT/JP2022/034007

§ 371 (c)(1),
(2) Date: Jul. 11, 2024

(87) PCT Pub. No.: WO2023/145125

PCT Pub. Date: Aug. 3, 2023

(65) Prior Publication Data

US 2025/0085024 A1 Mar. 13, 2025

(30) Foreign Application Priority Data

Jan. 25, 2022 (JP) ..... 2022-009043

(51) Int. Cl.
*F24H 9/14* (2006.01)
*F24H 9/1832* (2022.01)
*F24H 15/238* (2022.01)

(52) U.S. Cl.
CPC ..... *F24H 9/1832* (2022.01); *F24H 15/238* (2022.01)

(58) Field of Classification Search
CPC . F24H 9/1832; F24H 1/14; F24H 8/00; F24H 15/238; F24H 1/145; F24H 8/006;
(Continued)

(56) References Cited

U.S. PATENT DOCUMENTS 9,004,017 B2 * 4/2015 Narita ..... C02F 1/008 366/279
10,088,197 B2 * 10/2018 Hamagami ..... F24D 19/0092
2013/0214053 A1 8/2013 Narita

FOREIGN PATENT DOCUMENTS

CN 1626985 A 6/2005
CN 110567147 A 12/2019
(Continued)

OTHER PUBLICATIONS

Office Action from the New Zealand Patent Office dated Feb. 3, 2026, in NZ application No. 813584.
(Continued)

*Primary Examiner* — Gregory A Wilson

(74) *Attorney, Agent, or Firm* — J-TEK LAW PLLC; Jeffrey D. Tekanic; Scott T. Wakeman

(57) ABSTRACT

A water heater (1) includes a housing (8), combustion devices (31, 32), heat exchangers (41A to 42B), a water supply pipe (P1), a hot water supply pipe (P2), a water supply connection member (10), a hot water supply connection member (20), a water quantity control part (50), and a fine bubble generator (9) in fluid connection with either the water supply pipe (P1) or the hot water supply pipe (P2). The fine bubble generator (9) has an inflow port (91H), into which hot water flows from an upstream side (P2U), and an outflow port (92H), out of which hot water containing the fine bubbles is discharged to a downstream side (P2D). The fine bubble generator (9) is located below burner ports (31F, 32F) of the combustion devices.

14 Claims, 10 Drawing Sheets

(58) Field of Classification Search
CPC . F24H 9/02; F24H 9/06; F24H 9/1836; F24H 9/20; F24D 17/0026; F24D 2200/043; F24D 2200/046
See application file for complete search history.

(56) References Cited

FOREIGN PATENT DOCUMENTS

| | | | | |
|---|---|---|---|---|
| CN | 111156685 | A | | 5/2020 |
| CN | 215260533 | U | * | 12/2021 |
| JP | S58131344 | U | | 9/1983 |
| JP | S5981440 | A | | 5/1984 |
| JP | H1073325 | A | | 3/1998 |
| JP | 2006034877 | A | * | 2/2006 |
| JP | 2007271099 | A | | 10/2007 |
| JP | 2009186092 | A | * | 8/2009 |
| JP | 2012152462 | A | * | 8/2012 |
| JP | 2012251687 | A | | 12/2012 |
| JP | 2013170793 | A | | 9/2013 |
| JP | 2013190176 | A | * | 9/2013 |
| JP | 2016109331 | A | * | 6/2016 |
| JP | 2019066112 | A | | 4/2019 |
| JP | 2020171914 | A | | 10/2020 |
| JP | 2021012000 | A | * | 2/2021 |
| JP | 2021055929 | A | | 4/2021 |
| JP | 2021105484 | A | | 7/2021 |
| WO | WO-2010067454 | A1 | * | 6/2010 ..... F24D 19/0092 |

OTHER PUBLICATIONS

Office Action and Search Report from the Chinese Patent Office dispatched Aug. 13, 2025 in related application No. 202280009612.X, and translation thereof.
Office Action and Search Report from the Japanese Patent Office dispatched Sep. 24, 2025 in related application No. 2022-009043, and translation thereof.
Office Action from the Australian Patent Office dated Sep. 8, 2025, in related Australian application No. 2022436248.
Office Action from the Australian Patent Office dated May 1, 2026 in AU application No. 2022436248.
English translation of the Written Opinion of the International Searching Authority in parent application No. PCT/JP2022/034007.
English translation of the International Search Report dispatched Nov. 1, 2022 for parent application No. PCT/JP2022/034007.
Communication from the European Patent Office dated 5 Dec. 5, 2025. in related EP application No. 22 92 3985 including Search Opinion, Supplementary European Search Report and examined claims 1-14.
Office Action and Search Report from the Taiwanese Patent Office dispatched Dec. 18, 2025 in related application No. 111137924.

* cited by examiner

WATER HEATER

CROSS-REFERENCE

The present application is the US national stage of International application serial no. PCT/JP2022/034007 filed on Sep. 12, 2022, which claims priority to Japanese patent application no. 2022-009043 filed on Jan. 25, 2022.

TECHNICAL FIELD

The present invention generally relates to a water heater.

BACKGROUND ART

An example of a known water heater is disclosed in Patent Document 1. This water heater comprises a housing, a combustion device, and a heat exchanger.

The housing has a housing body. The housing body is substantially box-shaped, being recessed toward the rear, and has a housing opening that opens at the front. Although not illustrated in Patent Document 1, the housing has a front plate that covers the housing opening. The combustion device is accommodated in the housing. The combustion device has a combustion chamber and a burner, with burner ports located in the combustion chamber, and generates high-temperature gas. The heat exchanger is accommodated above the combustion chamber in the housing. The heat exchanger converts water passing through the interior thereof into hot water by heating with the high-temperature gas.

As shown in FIG. 1, etc. in Patent Document 1, the water heater comprises a water supply pipe, a hot water supply pipe, a water supply connection member, and a hot water supply connection member.

The water supply pipe and the hot water supply pipe are accommodated in the housing and each is connected to the heat exchanger. The water supply connection member and the hot water supply connection member are located on the underside of the housing body. The water supply connection member is for connecting the water supply pipe to a water supply path that is outside the housing. The hot water supply connection member is for connecting the hot water supply pipe to a hot water supply path that is outside the housing. A water quantity control part that controls the flow rate of the water flowing through the water supply pipe is provided between the water supply connection member and the water supply pipe.

An example of a known fine bubble generator is disclosed in Patent Document 2. This fine bubble generator is disposed, for example, in a shower device or midway along a pipe leading to a tap faucet. This fine bubble generator has a substantially tubular shape with a length in the axial direction that is greater than the outer width. This fine bubble generator causes fine bubbles to be generated in hot water that flows through the interior thereof. Note that, with regard to this fine bubble generator, the greater the extent to which the length in the axial direction is greater than the outer diameter, the more readily the fineness of the fine bubbles generated in the hot water will be increased.

PRIOR ART LITERATURE

Patent Documents

Patent Document 1: JP 2021-55929 A
Patent Document 2: JP 2020-171914 A

SUMMARY OF THE INVENTION

Here, accommodating the aforementioned known fine bubble generator in the housing of the aforementioned known water heater has been considered. However, in this case, the fine bubble generator tends to be space-consuming due to the long length thereof in the axial direction, and tends to be affected by the combustion device and the heat exchanger in the housing, the size and shape of which are constrained because of the locations in which it is installed. Therefore, water heaters accommodating a fine bubble generator in the housing tend to require various measures to curtail the effects of the combustion device and the heat exchanger thereon and, as a result, there is a risk of this leading to increases in manufacturing costs.

It is one non-limiting object of the present teachings to disclose techniques for improving a water heater with which increases in manufacturing costs can be curtailed, in configurations in which a fine bubble generator is accommodated in the housing.

In one aspect of the present teachings, a water heater may comprise: a housing having a substantially box-shaped housing body that is recessed toward the rear and has a housing opening that opens at the front, and a front plate that covers the housing opening;

- a combustion device, accommodated in the housing, which has a combustion chamber and a burner with one or more burner ports located in the combustion chamber, and which generates a high-temperature gas;
- a heat exchanger, accommodated above the combustion chamber in the housing, which converts water passing through the interior thereof into hot water by heating with the high-temperature gas;
- a water supply pipe, accommodated in the housing, located on a first side of the heat exchanger in a width direction that orthogonally intersects a front-rear direction and an up-down direction, and extending in the up-down direction, the water supply pipe being fluidly connected to the heat exchanger;
- a hot water supply pipe, accommodated in the housing, located on the first side of the heat exchanger in the width direction, and extending in the up-down direction, the hot water supply pipe being fluidly connected to the heat exchanger;
- a water supply connection member, located on the underside of the housing body, for connecting the water supply pipe to a water supply path that is outside the housing;
- a hot water supply connection member, located on the underside of the housing body, for connecting the hot water supply pipe to a hot water supply path that is outside the housing;
- a water quantity control part provided (disposed) between the water supply connection member and the water supply pipe, which controls the flow rate of water flowing through the water supply pipe; and
- a fine bubble generator, in the housing, which is connected midway along a specific pipe that is one of the water supply pipe and the hot water supply pipe, having a substantially tubular shape with a length in the axial direction that is greater than the outer width, which causes fine bubbles to be generated in hot water that flows through the interior thereof, the fine bubble generator having an inflow port, located in one axial direction, into which the hot water flows from the upstream side of the specific pipe, and an outflow port, located in the other axial direction, out of which the hot water containing the fine bubbles is discharged to the downstream side of the specific pipe, and the fine bubble generator being located below the burner port(s).

In the water heater of the above-mentioned aspect, owing to the configuration in which the fine bubble generator accommodated in the housing is located below the burner port(s) of the burner, the need for various measures for curtailing the effects of heat transferred to the fine bubble generator from the combustion device and the heat exchanger, for example, measures such as making the fine bubble generator from a highly heat-resistant resin (polymer) or metal, can be reduced. As a result, this water heater can reduce material costs and work costs for the fine bubble generator.

Accordingly, the water heater of the above-mentioned aspect can avoid manufacturing cost increases in configurations in which a fine bubble generator is accommodated in the housing.

The fine bubble generator is preferably located on the first side of the heat exchanger in the width direction.

According to this configuration, the fine bubble generator is arranged on the same side as the specific pipe in the width direction. Therefore, in this water heater, the need for an excessive pipe length between the specific pipe and the fine bubble generator can be avoided, and thus the space within the housing can be used efficiently.

The specific pipe is, in one aspect of the present teachings, the hot water supply pipe. In such a configuration, the inflow port is preferably located above the outflow port. Furthermore, the outflow port is preferably located at a height no lower than the height of a downstream side hot water supply flow path from the portion of the hot water supply pipe that connects to the outflow port to the hot water supply connection member.

According to this configuration, the positional relationship in the up-down direction is such that: inflow port>outflow port≥downstream side hot water supply flow path. Therefore, when draining water from the fine bubble generator, this water heater allows water to be drained via the hot water supply connection member, without providing a separate circuit (conduit) for draining water.

In the configuration described above, the fine bubble generator is preferably located above the water quantity control part.

According to this configuration, it is easily possible to touch the water quantity control part or remove the water quantity control part, by removing the portion of the hot water supply pipe that is located on the downstream side relative to the fine bubble generator. As a result, this water heater can achieve improvements in ease of maintenance.

In the above-noted aspect in which the specific pipe is the hot water supply pipe, when the fine bubble generator is viewed along the width direction in this configuration, the axial direction is preferably inclined such that the inflow port is located above the outflow port.

According to this configuration, it is possible to suitably achieve an arrangement of the fine bubble generator that is elongated in the axial direction, below the burner port(s) of the burner. In addition, because the fine bubble generator is inclined so that the inflow port is located above the outflow port, draining of water in the fine bubble generator can also be performed easily. As a result, this water heater can achieve improved anti-freezing performance.

In the configuration described above, one of the inflow port and the outflow port is preferably located rearward of the other of the inflow port and the outflow port and opens in the vertical (up-down) direction.

According to this configuration, when the inflow port is located rearward of the outflow port, the inflow port opens upward in the vertical direction. Therefore, in this water heater, the connection between the upstream side of the hot water supply pipe and the inflow port can be easily seen from the front, and the connection can also be easily touched by reaching a hand through the housing opening. In addition, when the outflow port is located rearward of the inflow port, the outflow port opens downward in the vertical direction. Therefore, in this water heater, the connection between the downstream side of the hot water supply pipe and the outflow port can be easily seen from the front, and the connection can be easily touched by reaching a hand through the housing opening. As a result thereof, this water heater can achieve still further improvements in ease of maintenance.

In addition, in the configuration described above, the outflow port is preferably located frontward of the inflow port.

From the viewpoint of ease of assembly operations, the hot water supply connection port of the hot water supply connection member, to which the hot water supply pipe is connected, often opens toward the front side of the housing. Therefore, owing to the configuration in which the outflow port is located frontward of the inflow port, it is possible to smoothly route the downstream side of the hot water supply pipe that connects to the outflow port to the hot water supply connection port of the hot water supply connection member. As a result, this water heater can achieve improvements in ease of assembly operations and ease of work, and reductions in manufacturing costs.

The specific pipe is, in another aspect of the present teachings, the water supply pipe. In this aspect, the outflow port is preferably located above the inflow port. Furthermore, the inflow port is preferably located at a height no lower than an upstream side water supply flow path from the water supply connection member to the portion of the water supply pipe that connects to the inflow port.

According to this configuration, the positional relationship in the up-down direction is such that: outflow port>inflow port≥upstream side water supply flow path. Therefore, when draining water from the fine bubble generator, this water heater allows water to be drained via the water supply connection member, without providing a separate circuit (conduit) for draining water.

In the configuration described above, the fine bubble generator is preferably located above the water quantity control part.

According to this configuration, it is easily possible to touch the water quantity control part or remove the water quantity control part, by removing the portion of the water supply pipe that is located on the upstream side relative to the fine bubble generator. As a result, this water heater can achieve improvements in ease of maintenance.

In the above-noted aspect in which the specific pipe is the water supply pipe, when the fine bubble generator is viewed along the width direction in this configuration, the axial direction is preferably inclined such that the outflow port is located above the inflow port.

According to this configuration, it is possible to suitably achieve an arrangement of the fine bubble generator that is elongated in the axial direction, below the burner port(s) of the burner. In addition, because the fine bubble generator is inclined so that the outflow port is located above the inflow port, draining of water in the fine bubble generator can also be performed easily. As a result, this water heater can achieve improved anti-freezing performance.

In the configuration described above, one of the inflow port and the outflow port is preferably located rearward of the other of the inflow port and the outflow port and opens in the vertical (up-down) direction.

According to this configuration, when the inflow port is located rearward of the outflow port, the inflow port opens downward in the vertical direction. Therefore, in this water heater, the connection between the upstream side of the water supply pipe and the inflow port can be easily seen from the front, and the connection can also be easily touched by reaching a hand through the housing opening. In addition, when the outflow port is located rearward of the inflow port, the outflow port opens upward in the vertical direction. Therefore, in this water heater, the connection between the downstream side of the water supply pipe and the outflow port can be easily seen from the front, and the connection can be easily touched by reaching a hand through the housing opening. As a result thereof, this water heater can achieve still further improvements in ease of maintenance.

In addition, in the configuration described above, the inflow port is preferably located frontward of the outflow port.

From the viewpoint of ease of assembly operations, the water supply connection port of the water quantity control part, to which the water supply pipe is connected, often opens toward the front side of the housing. Therefore, owing to the configuration in which the inflow port is located frontward of the outflow port, it is possible to smoothly route the upstream side of the water supply pipe, which connects to the inflow port, to the water supply connection port of the water quantity control part. As a result, this water heater can achieve improvements in ease of assembly operations and ease of work, and reductions in manufacturing costs.

The fine bubble generator preferably has: an inflow part, in which the inflow port is formed, that connects to the upstream side of the specific pipe; an outflow part, in which the outflow port is formed, that connects to the downstream side of the specific pipe; and a body part, connected to the inflow part in the one axial direction and connected to the outflow part in the other axial direction, which causes fine bubbles to be generated in the hot water that flows through the interior thereof. Furthermore, the inflow part, the outflow part, and the body part are preferably each configured as separate components.

According to this configuration, by preparing multiple types of inflow parts and outflow parts with different shapes in advance, and by using inflow parts and outflow parts appropriately selected from among these, it is easily possible to support various connection/mounting formats, for example, vertical mounting, inclined mounting with vertical directional inflow/outflow, and the like.

Water heater of the present teachings can avoid manufacturing cost increases in configurations in which a fine bubble generator is accommodated in a housing.

BRIEF DESCRIPTION OF THE DRAWINGS

FIG. 4 is a partial oblique view, relating to the water heater of Working Example 1, showing combustion chambers, burner ports of burners, a fine bubble generator, and the like.

FIG. 6 is an exploded oblique view, relating to the water heater of Working Example 1, showing a hot water supply pipe, the fine bubble generator, a hot water supply connection member, a hot water filling water control part, a water supply connection member, a water quantity control part, a bypass pipe, and the like.

FIG. 7 is a side view, relating to the water heater of Working Example 1, showing the hot water supply pipe, the bypass pipe, the fine bubble generator, the water supply connection member, the hot water supply connection member, the water quantity control part, the hot water filling water control part, and the like.

FIG. 10 is a side view, relating to the water heater of Working Example 2, showing a water supply pipe, a fine bubble generator, a water supply connection member, a hot water supply connection member, a water quantity control part, a hot water filling water control part, and the like.

DETAILED DESCRIPTION

Working Examples 1 and 2, embodying aspects of the present teachings, are described hereafter, with reference to the drawings.

Working Example 1

Figure 1:
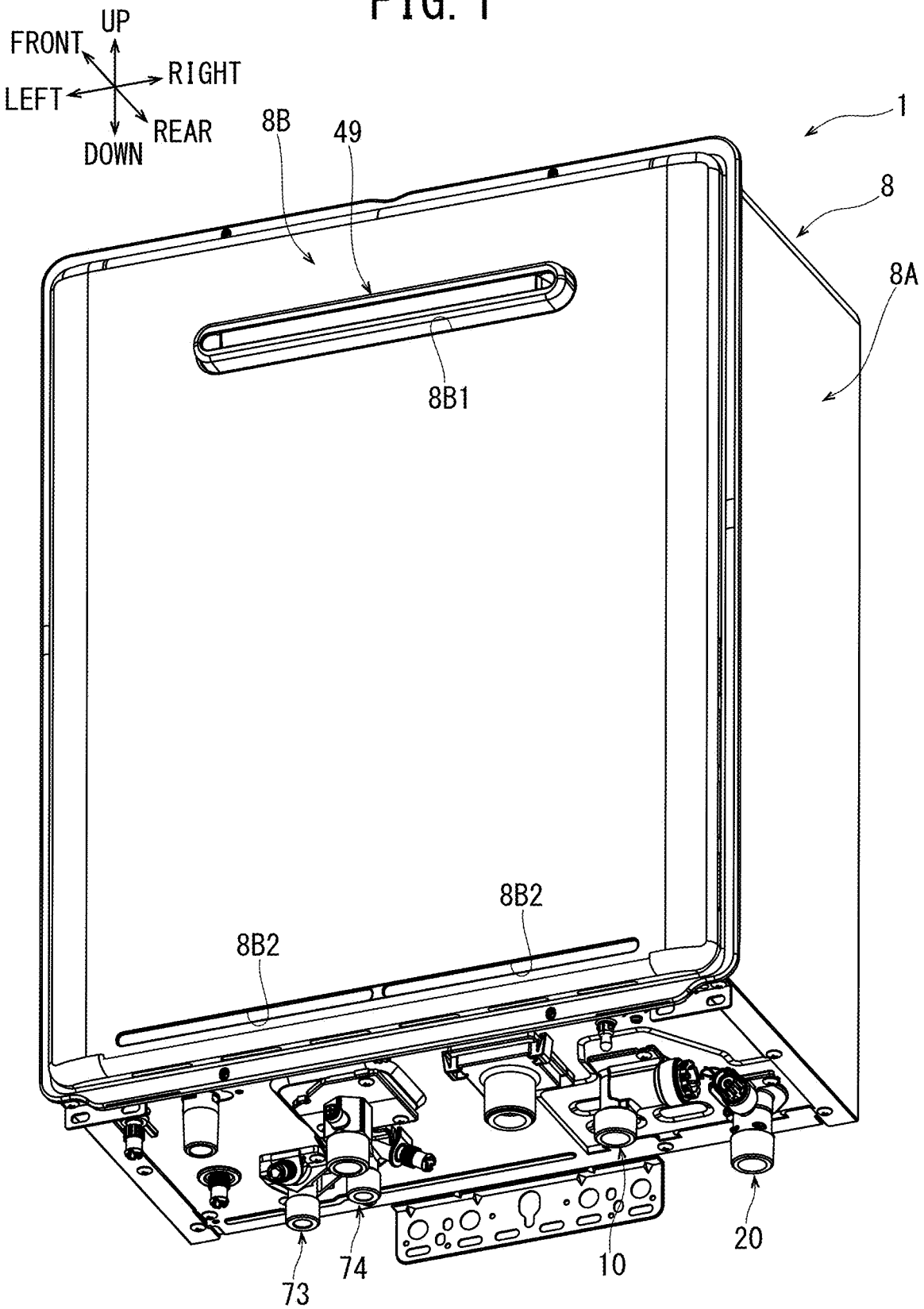
FIG. 1 is an oblique view of a water heater of Working Example 1.

A water heater 1 of Working Example 1, as shown in FIG. 1, is one example of a specific aspect of the water heater of the present teachings. In the following description: a front plate 8B side of a housing 8 of a water heater 1, which is to say the near side, on the page, in FIG. 1, is defined as frontward relative to the water heater 1; the left side, on the page, in FIG. 1 is defined as leftward relative to the water heater 1; and the upper side, on the page, in FIG. 1 is defined as upward relative to the water heater 1. Furthermore, the front, rear, left, right, up, and down directions shown in FIG. 2 and subsequent figures are all shown so as to correspond to the directions in FIG. 1. The constituent elements of the water heater 1 will be described hereafter.

Housing

As shown in FIG. 1, the water heater 1 comprises the housing 8. The housing 8 has a housing body 8A and the front plate 8B.

Figure 2:
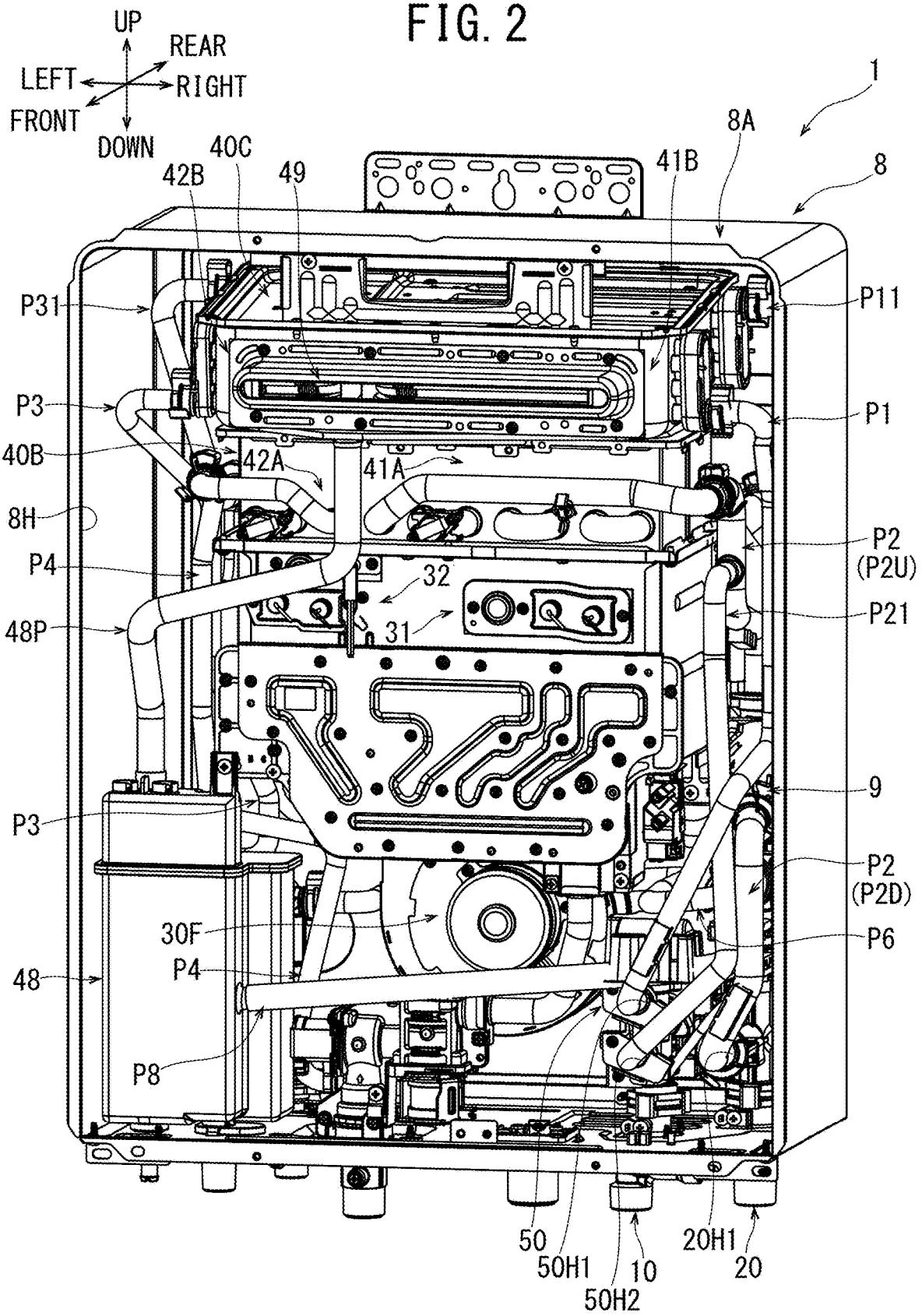
FIG. 2 is an oblique view, relating to the water heater of Working Example 1, showing a state in which a front plate has been removed.

As shown in FIG. 2, the housing body 8A is substantially box-shaped, being recessed toward the rear, and has a housing opening 8H that opens at the front. As shown in FIG. 1, the front plate 8B has a substantially rectangular flat-plate shape and covers the housing opening 8H. The housing body 8A and the front plate 8B define a substantially rectangular parallelepiped-shaped internal space.

The width direction of the housing 8 is the direction that orthogonally intersects the front-rear direction and the up-down direction, and is consistent with the left-right direction in Working Example 1. The water heater 1 is often installed in a pipe shaft in an apartment building. Therefore, the size and shape of the housing 8 in the up-down direction, the front-rear direction, and the width direction are constrained so as to fit in such a pipe shaft.

An exhaust opening 8B1 is provided at the upper end side of the front plate 8B, which exposes an exhaust port 49, which is described hereafter. An outside air intake opening 8B2 for introducing outside air into the housing 8 is provided at the lower end side of the front plate 8B.

Combustion Fan, First Combustion Device, and Second Combustion Device

Figure 3:
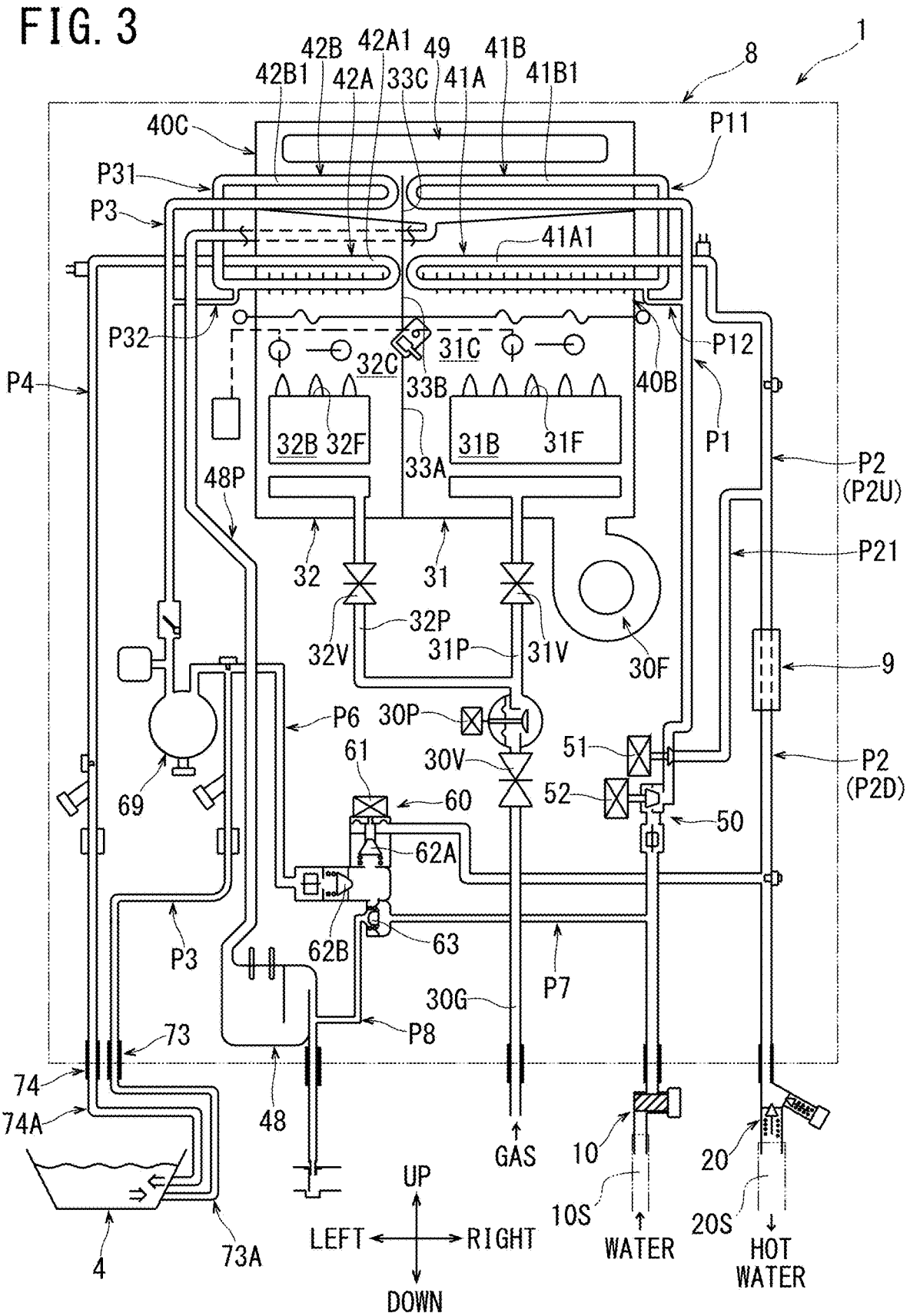
FIG. 3 is a schematic block diagram of the water heater of Working Example 1.

As shown in FIG. 2 and FIG. 3, the water heater 1 comprises a combustion fan 30F, a first combustion device 31, and a second combustion device 32. The first combustion device 31 and the second combustion device 32 constitute one example of a "combustion device" of the present teachings.

The combustion fan 30F is accommodated in a lower part within the housing 8. The combustion fan 30F supplies air for combustion to the first combustion device 31 and the second combustion device 32.

Figure 4:
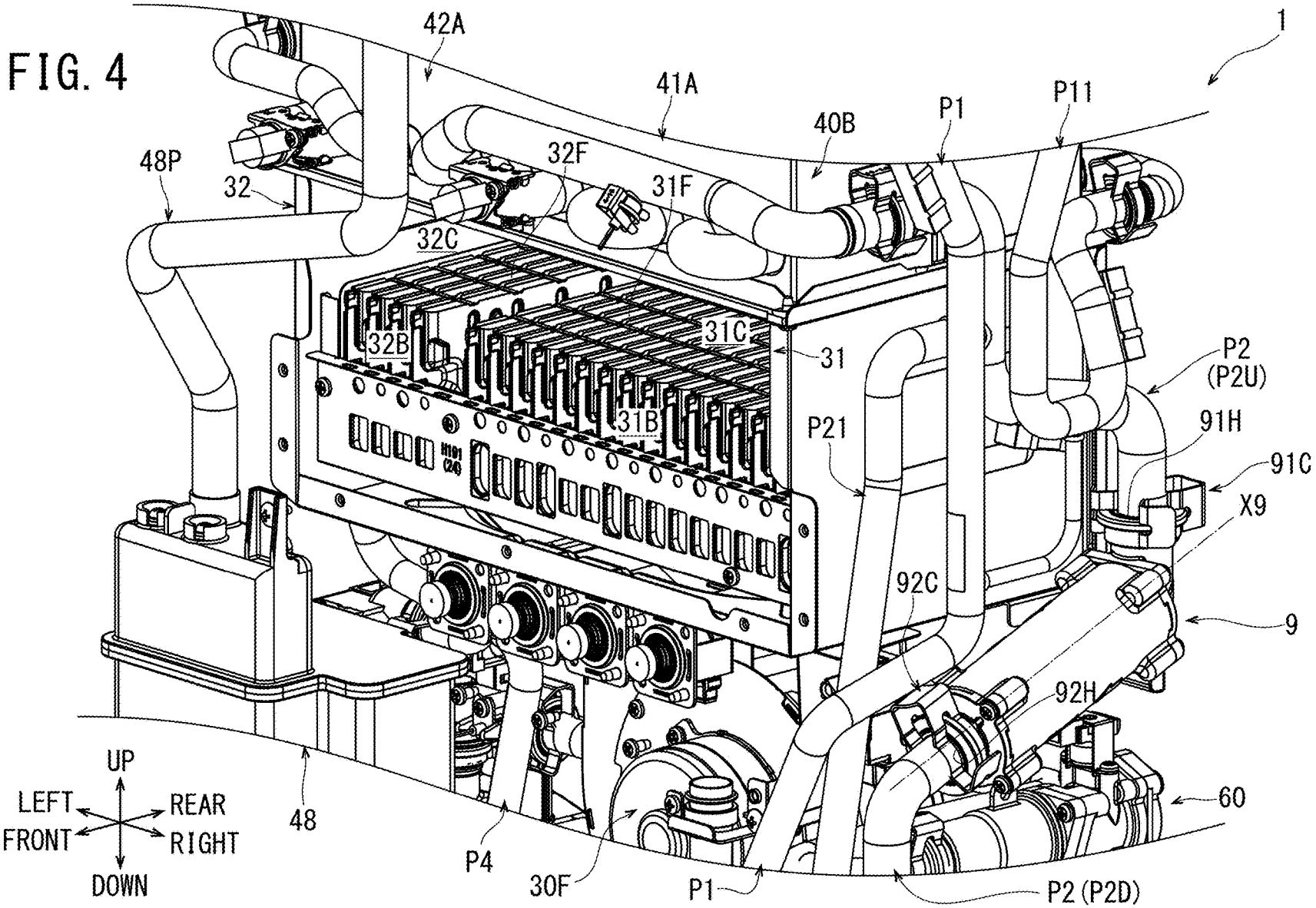

The first combustion device 31 and the second combustion device 32 are accommodated in an intermediate part, in the up-down direction, in the housing 8. As shown in FIG. 3 and FIG. 4, the second combustion device 32 is located on the left of the first combustion device 31 and is smaller than the first combustion device 31.

The first combustion device 31 has a combustion chamber 31C and a burner 31B. The second combustion device 32 has a combustion chamber 32C and a burner 32B. The combustion chamber 31C and the burner 31B and the combustion chamber 32C and the burner 32B are partitioned by a partition plate 33A shown in FIG. 3.

In FIG. 4, illustration of the partition plate 33A is omitted. In the first combustion device 31, burner ports 31F of the burner 31B are located in the combustion chamber 31C, a plurality thereof being arranged arrayed in the front-rear direction and the left-right direction. In the second combustion device 32, the burner ports 32F of the burner 32B are located in the combustion chamber 32C, a plurality thereof being arranged arrayed in the front-rear direction and the left-right direction.

Figure 7:
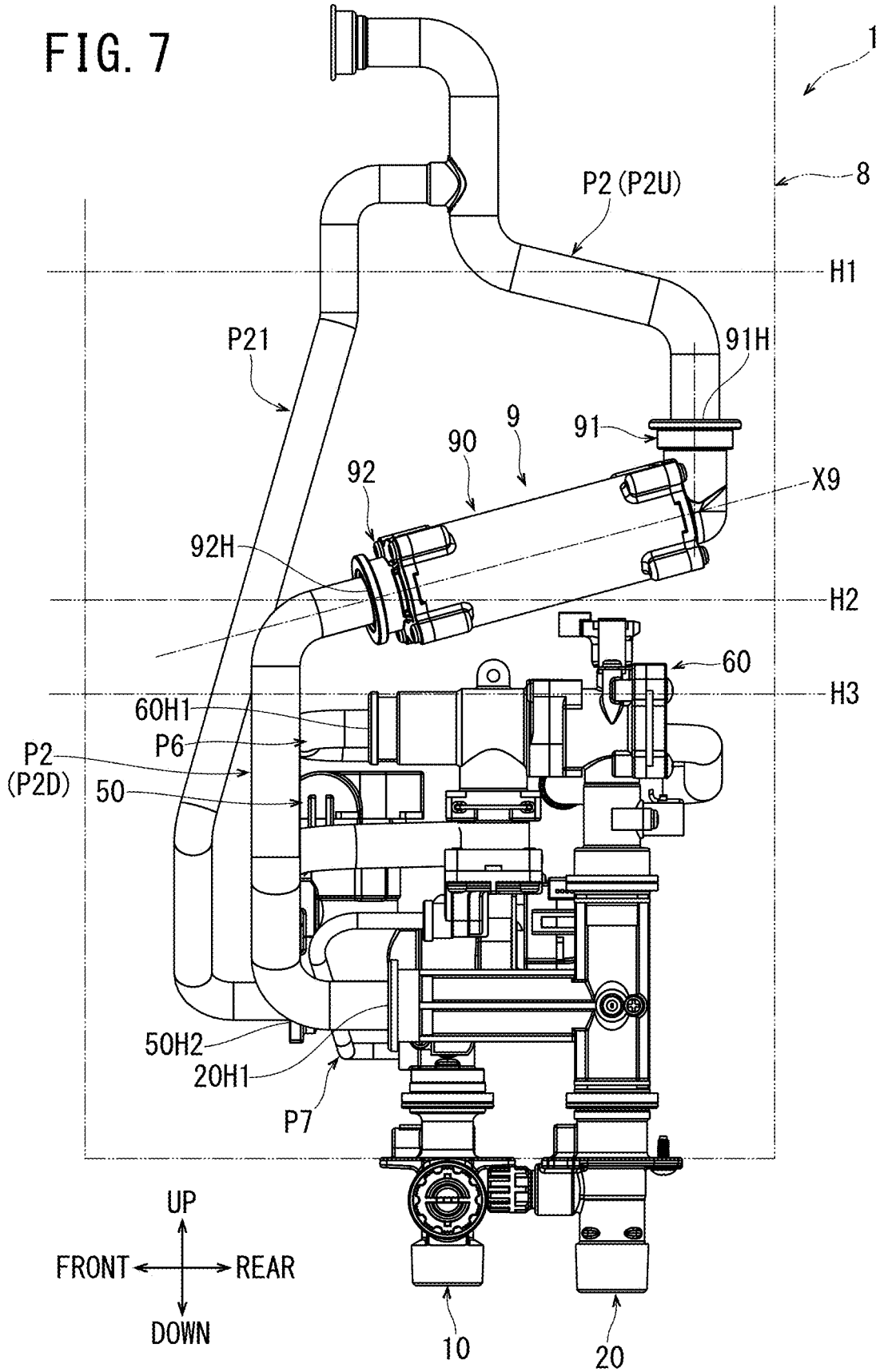

The height of the burner ports 31F of the burner 31B is the same as the height of the burner ports 32F of the burner 32B. In FIG. 7, the height of the burner ports 31F, 32F of the burners 31B, 32B is shown by the height H1.

As shown in FIG. 3, in the first combustion device 31, fuel gas such as city gas (methane), propane gas, or the like is supplied, from a non-illustrated gas supply source that is outside the housing 8, to the burner 31B, via a gas supply pipe 30G, a main gas solenoid valve 30V, a gas proportional valve 30P, a branch pipe 31P, and a first gas solenoid valve 31V. The burner 31B discharges the fuel gas from the burner ports 31F so as to burn the fuel gas. The first combustion device 31 thereby generates high-temperature gas, which is combustion exhaust gas.

In the second combustion device 32, fuel gas is supplied from a non-illustrated gas supply source that is outside the housing 8, to the burner 32B, via the gas supply pipe 30G, the main gas solenoid valve 30V, the gas proportional valve 30P, a branch pipe 32P, and a second gas solenoid valve 32V. The burner 32B discharges the fuel gas from the burner ports 32F so as to burn the fuel gas. The second combustion device 32 thereby generates high-temperature gas, which is combustion exhaust gas.

First Main Heat Exchanger, First Auxiliary Heat Exchanger, Second Main Heat Exchanger, and Second Auxiliary Heat Exchanger As shown in FIG. 2 and FIG. 3, the water heater 1 comprises a first main heat exchanger 41A, a first auxiliary heat exchanger 41B, a second main heat exchanger 42A, and a second auxiliary heat exchanger 42B.

The first main heat exchanger 41A, the first auxiliary heat exchanger 41B, the second main heat exchanger 42A, and the second auxiliary heat exchanger 42B constitute one example of a "heat exchanger" of the present teachings.

As shown in FIG. 3, the second combustion device 32, the second main heat exchanger 42A, and the second auxiliary heat exchanger 42B described above are for performing reheating of a bathtub 4 installed in a bathroom or the like. In other words, the water heater 1 is a bath water heater.

The first main heat exchanger 41A, the first auxiliary heat exchanger 41B, the second main heat exchanger 42A, and the second auxiliary heat exchanger 42B are accommodated in an upper part within the housing 8.

The first main heat exchanger 41A is located above the combustion chamber 31C of the first combustion device 31. The second main heat exchanger 42A is located above the combustion chamber 32C of the second combustion device 32.

The first main heat exchanger 41A and the second main heat exchanger 42A share an outer box 40B shown in FIG. 2, and are partitioned by a partition plate 33B shown in FIG. 3.

The first auxiliary heat exchanger 41B is located above the first main heat exchanger 41A. The second auxiliary heat exchanger 42B is located above the second main heat exchanger 42A.

The first auxiliary heat exchanger 41B and the second auxiliary heat exchanger 42B share a can body 40C shown in FIG. 2, and are partitioned by a partition plate 33C shown in FIG. 3.

As shown in FIG. 2, the can body 40C has an exhaust port 49. The exhaust port 49 protrudes frontward from the front of the can body 40C. As shown in FIG. 1, the exhaust port 49 passes through the exhaust opening 8B1 in the front plate 8B and is exposed at the outside of the housing 8.

The high-temperature gas generated by the first combustion device 31 and the second combustion device 32 rises inside the outer box 40B and the can body 40C and is discharged from (via) the exhaust port 49 to the outside of the housing 8.

As shown in FIG. 3, the first main heat exchanger 41A has a heat transfer pipe 41A1. The heat transfer pipe 41A1 is illustrated in a simplified manner in FIG. 3, but the heat transfer pipe 41A1 meanders, including a plurality of straight portions and a plurality of turn portions, which turn in arcs to connect each of the straight portions. Each of the straight portions of the heat transfer pipe 41A1 has a plurality of heat transfer fins.

The first main heat exchanger 41A performs heat exchange between the water circulating in the heat transfer pipe 41A1 and the high-temperature gas generated by the first combustion device 31 and absorbs sensible heat of the high-temperature gas.

The first auxiliary heat exchanger 41B has a heat transfer pipe 41B1. The heat transfer pipe 41B1 is illustrated in a simplified manner in FIG. 3, but the heat transfer pipe 41B1 is a corrugated pipe that meanders, including a plurality of straight portions and a plurality of turn portions that turn in arcs to connect each of the straight portions.

The first auxiliary heat exchanger 41B performs heat exchange between the water circulating in the heat transfer pipe 41B1 and the high-temperature gas generated by the first combustion device 31 and absorbs latent heat of the high-temperature gas.

The second main heat exchanger 42A has a heat transfer pipe 42A1 that has a configuration similar to the heat transfer pipe 41A1. The second main heat exchanger 42A performs heat exchange between the water circulating in the heat transfer pipe 42A1 and the high-temperature gas generated by the second combustion device 32 and absorbs sensible heat of the high-temperature gas.

The second auxiliary heat exchanger 42B has a heat transfer pipe 42B1 that has a configuration similar to the heat transfer pipe 41B1. The second auxiliary heat exchanger 42B performs heat exchange between the water circulating in the heat transfer pipe 42B1 and the high-temperature gas generated by the second combustion device 32 and absorbs latent heat of the high-temperature gas.

In this way, the first main heat exchanger 41A, the first auxiliary heat exchanger 41B, the second main heat exchanger 42A, and the second auxiliary heat exchanger 42B each heat the water passing through the interior thereof using the high-temperature gas to convert this to hot water.

As shown in FIG. 2 and FIG. 3, the upper end of a drain pipe 48P is connected to the bottom wall of the can body 40C. The lower end of the drain pipe 48P is connected to a neutralizer 48. Drainage generated by condensation in the can body 40C is guided to the neutralizer 48 by the drain pipe 48P. After neutralizing the drainage using a neutralizing agent, the neutralizer 48 discharges the drainage to the outside of the housing 8.

Water Supply Pipe, Intermediate Water Supply Pipe, Hot Water Supply Pipe, and Bypass Pipe As shown in FIG. 2 to FIG. 5, the water heater 1 comprises a water supply pipe P1, an intermediate water supply pipe P11, a hot water supply pipe P2, and a bypass pipe P21. The hot water supply pipe P2 is one example of a "specific pipe" of the present teachings.

The water supply pipe P1, the intermediate water supply pipe P11, the hot water supply pipe P2, and the bypass pipe P21 are accommodated in the housing 8. The water supply pipe P1, the intermediate water supply pipe P11, the hot water supply pipe P2, and the bypass pipe P21 are located on a first side, that is one side, which is to say, on the right, of the first main heat exchanger 41A, the first auxiliary heat exchanger 41B, the second main heat exchanger 42A, and the second auxiliary heat exchanger 42B, in the width direction.

In addition, the water supply pipe P1, the intermediate water supply pipe P11, the hot water supply pipe P2, and the bypass pipe P21 are located on the right of the first combustion device 31 and the second combustion device 32, in the width direction.

Figure 5:
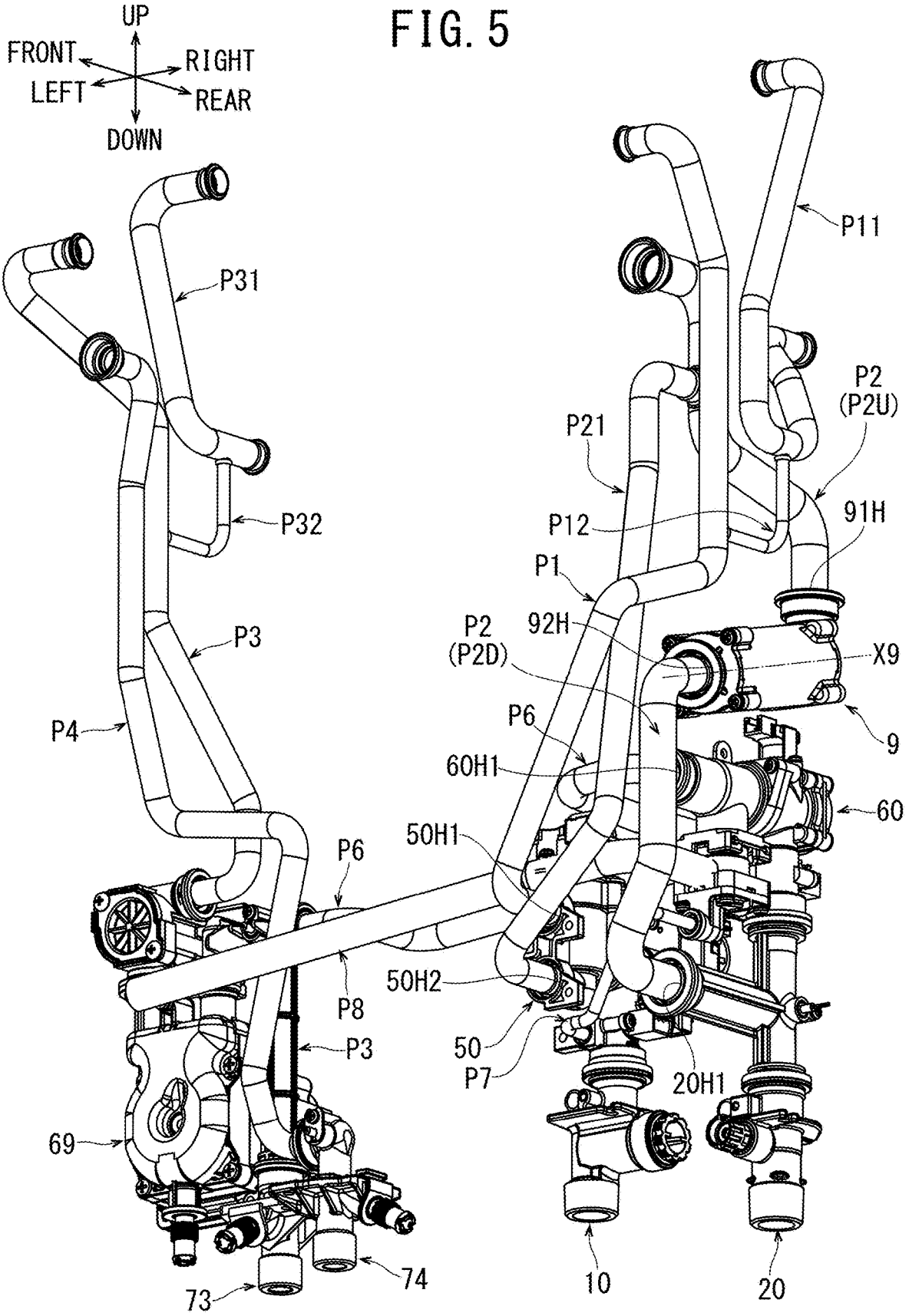
FIG. 5 is an oblique view, relating to the water heater of Working Example 1, showing a state in which a housing body, a combustion fan, a first combustion device, a second combustion device, a first main heat exchanger, a first auxiliary heat exchanger, a second main heat exchanger, a second auxiliary heat exchanger, and the like have been removed from FIG. 2.

As shown in FIG. 3 and FIG. 5, the upstream end of the water supply pipe P1 is connected to a water supply connection port 50H1 of a water quantity control part 50, which is described hereafter. The downstream end of the water supply pipe P1 is located above the upstream end of the water supply pipe P1. The downstream end of the water supply pipe P1 is connected to an inlet of the heat transfer pipe 41B1 of the first auxiliary heat exchanger 41B. The water supply pipe P1 extends in the up-down direction bending multiple times between the upstream end and the downstream end.

The upstream end of the intermediate water supply pipe P11 is connected to an outlet of the heat transfer pipe 41B1 of the first auxiliary heat exchanger 41B. The downstream end of the intermediate water supply pipe P11 is located below the upstream end of the intermediate water supply pipe P11. The downstream end of the intermediate water supply pipe P11 is connected to an inlet of the heat transfer pipe 41A1 of the first main heat exchanger 41A.

An intermediate part of the water supply pipe P1 and an intermediate part of the intermediate water supply pipe P11 communicate via a narrow communication pipe P12.

The upstream end of the hot water supply pipe P2 is connected to an outlet of the heat transfer pipe 41A1 of the first main heat exchanger 41A. The downstream end of the hot water supply pipe P2 is located below the upstream end of the hot water supply pipe P2. The downstream end of the hot water supply pipe P2 is connected to a hot water supply connection port 20H1 of a hot water supply connection member 20, which is described hereafter. The hot water supply pipe P2 extends in the up-down direction bending multiple times between the upstream end and the downstream end. Midway along the hot water supply pipe P2, a fine bubble generator 9, which is described hereafter, is connected.

The upstream end of the bypass pipe P21 is connected to a bypass connection port 50H2 of the water quantity control part 50, which is described hereafter. The downstream end of the bypass pipe P21 is located above the upstream end of the bypass pipe P21. The downstream end of the bypass pipe P21 is connected in the vicinity of the upstream end of the hot water supply pipe P2.

Water Supply Connection Member, Hot Water Supply Connection Member, Water Quantity Control Part, and Hot Water Filling Water Control Part As shown in FIG. 2, FIG. 3, and FIG. 5, the water heater 1 comprises a water supply connection member 10, a hot water supply connection member 20, a water quantity control part 50, and a hot water filling water control part 60.

The water supply connection member 10 is located in the right portion of the underside of the housing body 8A. As shown in FIG. 3, a portion of the water supply connection member 10 that protrudes below the underside of the housing body 8A has a connection part that connects the water supply pipe P1 and (with, to) a water supply path 10S that is outside the housing 8, and has a combination water filter and drain tap.

A portion of the water supply connection member 10 that protrudes above the underside of the housing body 8A is connected to the water quantity control part 50.

As shown in FIG. 5, the water quantity control part 50 has a water supply connection port 50H1 to which the upstream end of the water supply pipe P1 is connected. In other words, the water quantity control part 50 is provided between the water supply connection member 10 and the water supply pipe P1. In addition, the water quantity control part 50 has the bypass connection port 50H2 to which the upstream end of the bypass pipe P21 is connected.

As shown in FIG. 3, the water quantity control part 50 has a bypass servo 51 and a water quantity servo 52.

The bypass servo 51 is switchable to: (i) a bypass closed state in which water supplied to the water quantity control part 50 is guided only to the water supply pipe P1, and (ii) a bypass open state in which water supplied to the water quantity control part 50 is guided not only to the water supply pipe P1 but also to the bypass pipe P21.

When the bypass servo 51 is in the bypass closed state, the water quantity servo 52 controls the flow rate of the water flowing through the water supply pipe P1. On the other hand, when the bypass servo 51 is in the bypass open state, the water quantity servo 52 controls the flow rate of the water flowing through the water supply pipe P1 and the bypass pipe P21.

As shown in FIG. 2, FIG. 3, and FIG. 5, the hot water supply connection member 20 is located on the right and at the rear of the water supply connection member 10, in the right portion of the underside of the housing body 8A. As shown in FIG. 3, a portion of the hot water supply connection member 20 that protrudes below the underside of the housing body 8A has a connection part that connects the hot water supply pipe P2 and (with, to) a hot water supply path 20S that is outside the housing 8, and has a water hammer damper valve, and a combination pressure safety valve and drain tap.

As shown in FIG. 5, a portion of the hot water supply connection member 20 that protrudes above the underside of the housing body 8A branches into a T-shape. At the frontward end of a portion protruding frontward from the branch, the hot water supply connection member 20 has a hot water supply connection port 20H1 to which the downstream end of the hot water supply pipe P2 is connected.

A portion that protrudes upward from the branch of the hot water supply connection member 20 is connected to the hot water filling water control part 60.

As shown in FIG. 3, the hot water filling water control part 60 has a hot water filling solenoid valve 61, check valves 62A, 62B, and an atmospheric release valve 63.

Figure 6:
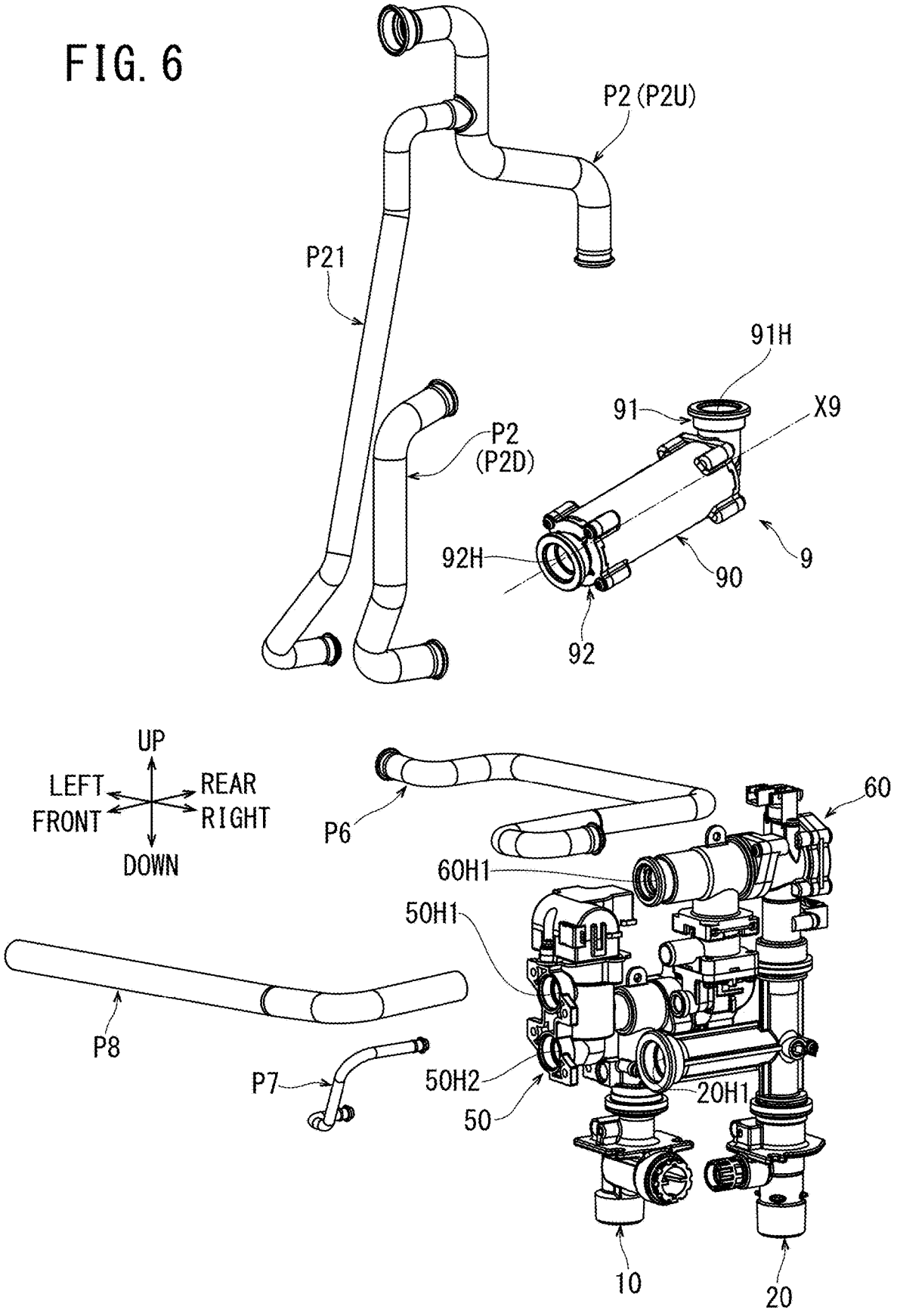

As shown in FIG. 5 and FIG. 6, one end of a hot water filling supply pipe P6 is connected to a hot water filling connection port 60H1 of the hot water filling water control part 60. As shown in FIG. 3 and FIG. 5, the other end of the hot water filling supply pipe P6 is connected to a bath return pipe P3, which is described hereafter, on the upstream side relative to a pump 69.

The hot water filling solenoid valve 61 is switchable between: (i) a hot water filling open state, in which water supplied to the hot water filling water control part 60 is supplied to the hot water filling supply pipe P6, and (ii) a hot water filling closed state in which water supplied to the hot water filling water control part 60 is not supplied to the hot water filling supply pipe P6.

The atmospheric release valve 63 of the hot water filling water control part 60 and the side of the water quantity control part 50 that is further upstream than the water quantity servo 52 communicate via a narrow communication pipe P7. In addition, the atmospheric release valve 63 and the drain side of the neutralizer 48 communicate via a communication pipe P8.

Bath Feed Pipe, Bath Return Pipe, and Pump

As shown in FIG. 3 and FIG. 5, the water heater 1 comprises the bath return pipe P3, an intermediate pipe P31, a bath feed pipe P4, and the pump 69.

The bath return pipe P3, the intermediate pipe P31, the bath feed pipe P4, and the pump 69 are accommodated in the housing 8. The bath return pipe P3, the intermediate pipe P31, the bath feed pipe P4, and the pump 69 are located on a second side, that is the other side, which is to say, on the left, of the first main heat exchanger 41A, the first auxiliary heat exchanger 41B, the second main heat exchanger 42A, and the second auxiliary heat exchanger 42B, in the width direction.

The upstream end of the bath return pipe P3 is connected to a bath return connection member 73 located in the left portion of the underside of the housing body 8A. The bath return connection member 73 is connected to a suction inlet of the bathtub 4 via an external pipe 73A.

The downstream end of the bath return pipe P3 is located above the upstream end of the bath return pipe P3. The downstream end of the bath return pipe P3 is connected to an inlet of the heat transfer pipe 42B1 of the second auxiliary heat exchanger 42B.

The pump 69 is connected midway along the bath return pipe P3, and the other end of the hot water filling supply pipe P6 is connected to the bath return pipe P3 on the upstream side relative to the pump 69.

The upstream end of the intermediate pipe P31 is connected to an outlet of the heat transfer pipe 42B1 of the second auxiliary heat exchanger 42B. The downstream end of the intermediate pipe P31 is located below the upstream end of the intermediate pipe P31. The downstream end of the intermediate pipe P31 is connected to an inlet of the heat transfer pipe 42A1 of the second main heat exchanger 42A.

An intermediate part of the bath return pipe P3 and an intermediate part of the intermediate pipe P31 communicate via a narrow communication pipe P32.

The upstream end of the bath feed pipe P4 is connected to an outlet of the heat transfer pipe 42A1 of the second main heat exchanger 42A. The downstream end of the bath feed pipe P4 is located below the upstream end of the bath feed pipe P4. The downstream end of the bath feed pipe P4 is connected to a bath feed connection member 74 located in the left portion of the underside of the housing body 8A. The bath feed connection member 74 is connected to a hot water output port of the bathtub 4 via an external pipe 74A.

Fine Bubble Generator As shown in FIG. 2 to FIG. 7, the water heater 1 further comprises a fine bubble generator 9. The fine bubble generator 9 is connected midway along the hot water supply pipe P2 in the housing 8. The fine bubble generator 9 is located on the first side, which is to say, on the right, of the first main heat exchanger 41A, the first auxiliary heat exchanger 41B, the second main heat exchanger 42A, and the second auxiliary heat exchanger 42B, in the width direction.

In addition, the fine bubble generator 9 is located on the right of the first combustion device 31 and the second combustion device 32, in the width direction.

The fine bubble generator 9 is a device that causes fine bubbles to be generated in hot water that flows through the interior thereof. The fine (gas) bubbles are derived (originate) from air, etc. that is dissolved in the hot water, such that a supply of gas from the outside is unnecessary.

In Working Example 1, the fine bubble generator 9 is a so-called "microfine bubble generator," which causes fine bubbles including bubbles having diameters of less than 1 μm to be generated in hot water that flows through the interior thereof. Therefore, the fine bubble generator 9 has the configuration described hereafter.

Figure 8:
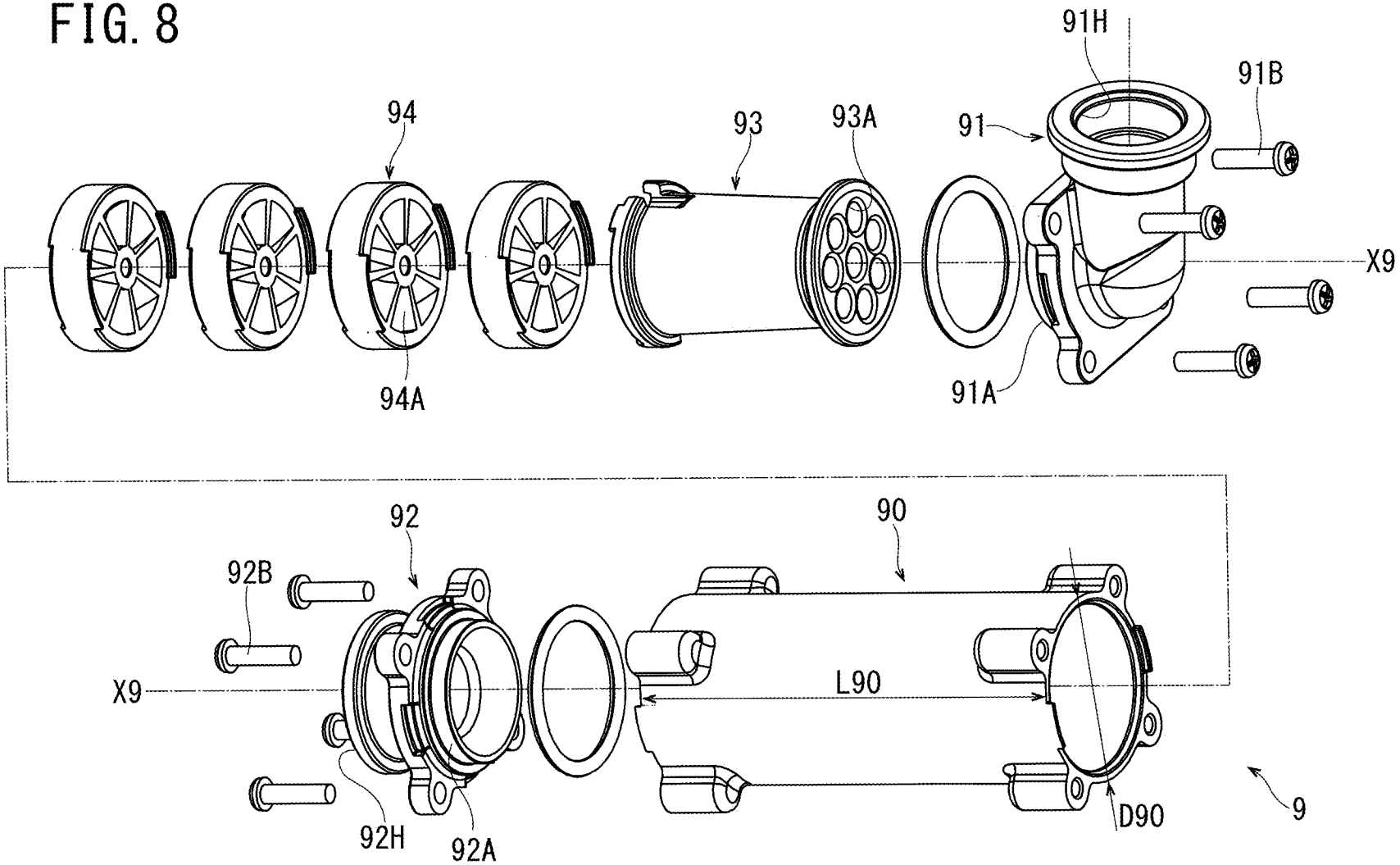
FIG. 8 is an exploded oblique view of the fine bubble generator, relating to the water heater of Working Example 1.

As shown in FIG. 8, the fine bubble generator 9 has a body part 90, an inflow part 91, and an outflow part 92. The body part 90, the inflow part 91, and the outflow part 92 are each configured as separate components. In Working Example 1, the body part 90, the inflow part 91, and the outflow part 92 are each made from a resin (polymer) that is heat resistant with respect to high-temperature hot water.

The body part 90 is substantially cylindrical, centered on an axis X9. The body part 90 is connected to the inflow part 91 in one axis X9 direction and is connected to the outflow part 92 in the other axis X9 direction.

The inflow part 91 has a fitting part 91A that fits with the body part 90 and is fastened to the body part 90 by a plurality of screws 91B. The inflow part 91 is bent upward from the fitting part 91A. An inflow port 91H centered on an axis intersecting the axis X9 is formed at the opposite end of the inflow part 91 to that of the fitting part 91A.

The outflow part 92 has a fitting part 92A that fits with the body part 90 and is fastened to the body part 90 by a plurality of screws 92B. An outflow port 92H centered on the axis X9 is formed at the opposite end of the outflow part 92 to that of the fitting part 92A.

The body part 90 incorporates a Venturi member 93 and a plurality of stirring (agitation) members 94. The Venturi member 93 and each of the stirring members 94 are also made from a resin (polymer) that is heat resistant with respect to high-temperature hot water. The Venturi member 93 is located on the inflow part 91 side, and the stirring members 94 are each located on the outflow part 92 side.

A plurality of Venturi flow paths 93A are formed in the Venturi member 93. One Venturi flow path 93A is centered on the axis X9. The remaining Venturi flow paths 93A are arranged at equal intervals in the circumferential direction of axis X9 and extend parallel to the axis X9. Each of the Venturi flow paths 93A has, midway therealong, a constricted portion that is constricted, a diameter-reducing flow path, in which the diameter is reduced from the inflow part 91 side toward the constricted portion, and a diameter expanding flow path, in which the diameter is expanded from the constricted portion toward the outflow part 92 side.

A plurality of blades 94A are formed in each of the stirring members 94. The blades 94A are each arranged at equal intervals in the circumferential direction of axis X9 and are each inclined with respect to the axis X9.

By using such a Venturi member 93 and such stirring members 94, the body part 90 causes fine bubbles including bubbles having diameters of less than 1 μm to be generated in the hot water that flows through the interior thereof. In particular, by increasing the number of stirring members 94 that are arrayed in series, bubbles having diameters of less than 1 μm are more readily generated, and the length L90 in the axis X9 direction of the body part 90 increases commensurate therewith.

The length L90 in the axis X9 direction of the body part 90 is greater than the outer diameter D90 of the body part 90. That is to say, the fine bubble generator 9 has a substantially tubular shape (substantially cylindrical shape) with a length in the axis X9 direction that is greater than the outer width (outer diameter). In Working Example 1, the length L90 is more than twice the outer diameter D90.

As shown in FIG. 4 to FIG. 7, the fine bubble generator 9 is connected midway along the hot water supply pipe P2 in a state in which the axis X9 direction is inclined. When the fine bubble generator 9 is viewed along the width direction, the axis X9 direction is inclined such that the inflow port 91H is located above the outflow port 92H. In Working Example 1, the axis X9 direction extends substantially parallel to the front-rear direction and the up-down direction.

In this state, one of the axis X9 directions is rearward and the other of the axis X9 directions is frontward. The outflow port 92H is located frontward of the inflow port 91H. The inflow port 91H is located rearward of the outflow port 92H and opens upward in the vertical direction.

The inflow port 91H is located in one axis X9 direction, which is to say, rearward, of the body part 90, and is connected to the upstream side P2U of the hot water supply pipe P2. Hot water flows into the inflow port 91H from the upstream side P2U of the hot water supply pipe P2.

The outflow port 92H is located in the other axis X9 direction, which is to say, frontward, of the body part 90, and is connected to the downstream side P2D of the hot water supply pipe P2. The outflow port 92H discharges hot water containing fine bubbles to the downstream side P2D of the hot water supply pipe P2.

As shown in FIG. 4, the upstream side P2U of the hot water supply pipe P2 and the inflow part 91 are fixed by a metal clip 91C in one action. Similarly, the downstream side P2D of the hot water supply pipe P2 and the outflow part 92 are fixed by a metal clip 92C in one action.

The burner ports 31F, 32F are illustrated in FIG. 4, and the height of the burner ports 31F, 32F, as shown by height H1 in FIG. 7, is such that the fine bubble generator 9 is located below the burner ports 31F, 32F of the burners 31B, 32B.

In FIG. 7, the height of a downstream side hot water supply flow path from the portion that connects to the outflow port 92H on the downstream side P2D of the hot water supply pipe P2 to the hot water supply connection member 20 is shown by height H2. The outflow port 92H is located at a height no lower than the height H2 of the downstream side hot water supply flow path.

In FIG. 7, the height of the internal flow path in the water quantity control part 50 is shown by a height H3. The fine bubble generator 9 is located above the water quantity control part 50 and more specifically above the height H3 of the internal flow path in the water quantity control part 50.

Hot Water Supply Operation

When a user has performed an operation for hot water supply, for example, an operation of opening a hot water output tap (faucet) of a hot water supply terminal, such as a mixing tap installed in a kitchen, a mixing tap installed in a bathroom, or a shower, the bypass servo 51 is usually in the bypass closed state, and the first combustion device 31 starts combustion to generate the high-temperature gas. Note that the bypass servo 51 is sometimes set to the bypass open state for special purposes such as maintaining the temperature of the hot water output from the first main heat exchanger 41A at a high temperature.

The water supplied from a water supply source, which is not illustrated, passes through the water supply path 10S, the water supply connection member 10, the water quantity control part 50, the water supply pipe P1, the heat transfer pipe 41B1 of the first auxiliary heat exchanger 41B, the intermediate water supply pipe P11, and the heat transfer pipe 41A1 of the first main heat exchanger 41A. At this time, that water is heated by the first auxiliary heat exchanger 41B and the first main heat exchanger 41A and becomes hot water. Furthermore, that hot water passes through the hot water supply pipe P2 and, midway therealong, fine bubbles including bubbles having a diameter of less than 1 μm are generated by the fine bubble generator 9.

Further, that hot water passes through the hot water supply connection member 20 and the hot water supply path 20S and flows out from the hot water output tap of the hot water supply terminal in a state in which fine bubbles are contained.

Hot Water Filling Operation

When a user has performed an operation for hot water filling, for example, an operation of pressing a hot water filling button on a hot water supply remote control installed in a kitchen, a bathroom, or the like, the first combustion device 31 starts combustion and generates a high-temperature gas. Depending on the situation, the bypass servo 51 switches to the bypass open state. The hot water filling solenoid valve 61 switches to the hot water filling open state. The pump 69 is stopped.

Water supplied from the water supply source, which is not illustrated, becomes hot water as a result of passing through the water supply pipe P1 in the same manner as in the hot water supply operation and flows into the hot water supply pipe P2. In addition, when the bypass servo 51 is in the bypass open state, a portion of the water supplied from the water supply source, which is not illustrated, flows into the hot water supply pipe P2 via the bypass pipe P21.

Furthermore, that hot water passes through the hot water supply pipe P2 and, midway therealong, fine bubbles including bubbles having a diameter of less than 1 μm are generated by the fine bubble generator 9.

Further, that hot water passes through the hot water supply connection member 20, the hot water filling water control part 60, and the hot water filling supply pipe P6, and flows into the bath return pipe P3 on the upstream side relative to the pump 69. Furthermore, a portion of that hot water passes through the pump 69, the heat transfer pipe 42B1 of the second auxiliary heat exchanger 42B, the intermediate pipe P31, the heat transfer pipe 42A1 of the second main heat exchanger 42A, the bath feed pipe P4, the bath feed connection member 74, and the external pipe 74A, to reach the bathtub 4. In addition, another portion of that hot water passes through the bath return pipe P3, the bath return connection member 73, and the external pipe 73A, to reach the bathtub 4. In this way, the hot water that has passed through the two paths is accumulated in the bathtub 4 in a state in which fine bubbles are contained.

Reheating Operation

When a user has performed an operation for reheating water, for example, an operation of pressing a reheating button on a hot water supply remote control installed in a kitchen, a bathroom, or the like, the second combustion device 32 starts combustion and generates high-temperature gas. The hot water filling solenoid valve 61 is in the hot water filling closed state.

The pump 69 is operated and circulates the hot water stored in the bathtub 4 in the order of: the external pipe 73A, the bath return connection member 73, the bath return pipe P3 (and thus through the pump 69), the heat transfer pipe 42B1 of the second auxiliary heat exchanger 42B, the intermediate pipe P31, the heat transfer pipe 42A1 of the second main heat exchanger 42A, the bath feed pipe P4, the bath feed connection member 74, and the external pipe 74A. As a result, the circulating hot water is reheated by the second auxiliary heat exchanger 42B and the second main heat exchanger 42A.

Functions and Effects

In the water heater 1 of Working Example 1, as shown in FIG. 4 and FIG. 7, owing to the configuration in which the fine bubble generator 9 accommodated in the housing 8 is located below the burner ports 31F, 32F of the burners 31B, 32B, the need for various measures for curtailing the effects of heat transferred to the fine bubble generator 9 from the first combustion device 31, the second combustion device 32, the first main heat exchanger 41A, the first auxiliary heat exchanger 41B, the second main heat exchanger 42A, and the second auxiliary heat exchanger 42B, for example, measures such as making the fine bubble generator 9 from a highly heat-resistant resin (polymer) or metal, can be reduced. As a result, this water heater 1 can reduce material costs and work costs for the fine bubble generator 9.

Accordingly, the water heater 1 of Working Example 1 can avoid manufacturing cost increases in configurations in which the fine bubble generator 9 is accommodated in the housing 8.

In addition, in this water heater 1, as shown in FIG. 2 to FIG. 4, the fine bubble generator 9 is located on the first side, which is to say, on the right, of the first main heat exchanger 41A, the first auxiliary heat exchanger 41B, the second main heat exchanger 42A, and the second auxiliary heat exchanger 42B, in the width direction. Owing to this configuration, the fine bubble generator 9 is arranged on the same side as the hot water supply pipe P2, in the width direction. Therefore, this water heater 1 can avoid the need for an excessive pipe length between the hot water supply pipe P2 and the fine bubble generator 9, and thus the space within the housing 8 can be used efficiently.

Further, in this water heater 1, as shown in FIG. 7, the inflow port 91H is located above the outflow port 92H. Furthermore, the outflow port 92H is located at a height no lower than the height H2 of the downstream side hot water supply flow path from the portion of the downstream side P2D of the hot water supply pipe P2, which connects to the outflow port 92H, to the hot water supply connection member 20. Owing to this configuration, the positional relationship in the up-down direction is such that: inflow port 91H>outflow port 92H≥height H2 of the downstream side hot water supply flow path. Therefore, when draining water from the fine bubble generator 9, this water heater 1 allows water to be drained via the hot water supply connection member 20, without providing a separate circuit (conduit) for draining water.

In addition, in this water heater 1, the fine bubble generator 9 is located above the water quantity control part 50 and more specifically above the height H3 of the internal flow path in the water quantity control part 50. Owing to this configuration, it is easily possible to touch the water quantity control part 50 or remove the water quantity control part 50 by removing the portion of the hot water supply pipe P2 that is located on the downstream side relative to the fine bubble generator 9, which is to say, the downstream side P2D of the hot water supply pipe P2. As a result, this water heater 1 can achieve improvements in ease of maintenance.

Further, in this water heater 1, when the fine bubble generator 9 is viewed along the width direction, the axis X9 direction is inclined such that the inflow port 91H is located above the outflow port 92H. Owing to this configuration, it is possible to suitably achieve an arrangement of the fine bubble generator 9 that is elongated in the axis X9 direction below the burner ports 31F, 32F of the burners 31B, 32B. In addition, because the fine bubble generator 9 is inclined so that the inflow port 91H is located above the outflow port 92H, draining of water in the fine bubble generator 9 can also be performed easily. As a result, this water heater 1 can achieve improved anti-freezing performance.

In addition, in this water heater 1, the inflow port 91H is located rearward of the outflow port 92H and opens upward in the vertical direction. Owing to this configuration, in this water heater 1, the connection between the upstream side P2U of the hot water supply pipe P2 and the inflow part 91 in which the inflow port 91H is formed can be easily seen from the front, and the connection can also be easily touched by reaching a hand through the housing opening 8H. As a result, this water heater 1 can achieve still further improvements in ease of maintenance.

Further, in this water heater 1, the outflow port 92H is located frontward of the inflow port 91H. From the viewpoint of ease of assembly operations, the hot water supply connection port 20H1 of the hot water supply connection member 20, to which the downstream end of the hot water supply pipe P2 is connected, often opens toward the front side of the housing 8, and this is also the case in Working Example 1. Therefore, owing to the configuration in which the outflow port 92H is located frontward of the inflow port 91H, it is possible to smoothly route the downstream side P2D of the hot water supply pipe P2, which connects to the outflow port 92H, to the hot water supply connection port 20H1 of the hot water supply connection member 20. As a result, this water heater 1 can achieve improvements in ease of assembly operations and ease of work, and reductions in manufacturing costs.

In addition, in this water heater 1, as shown in FIG. 8, the fine bubble generator 9 has the inflow part 91, the outflow part 92, and the body part 90, each configured as separate components. Owing to this configuration, by preparing multiple types of inflow parts 91 and outflow parts 92 with different shapes, in advance, and by using inflow parts 91 and outflow parts 92 appropriately selected from among these, it is easily possible to support various connection/mounting formats, for example, vertical mounting, inclined mounting with vertical direction inflow/outflow, and the like.

Working Example 2

Figure 9:
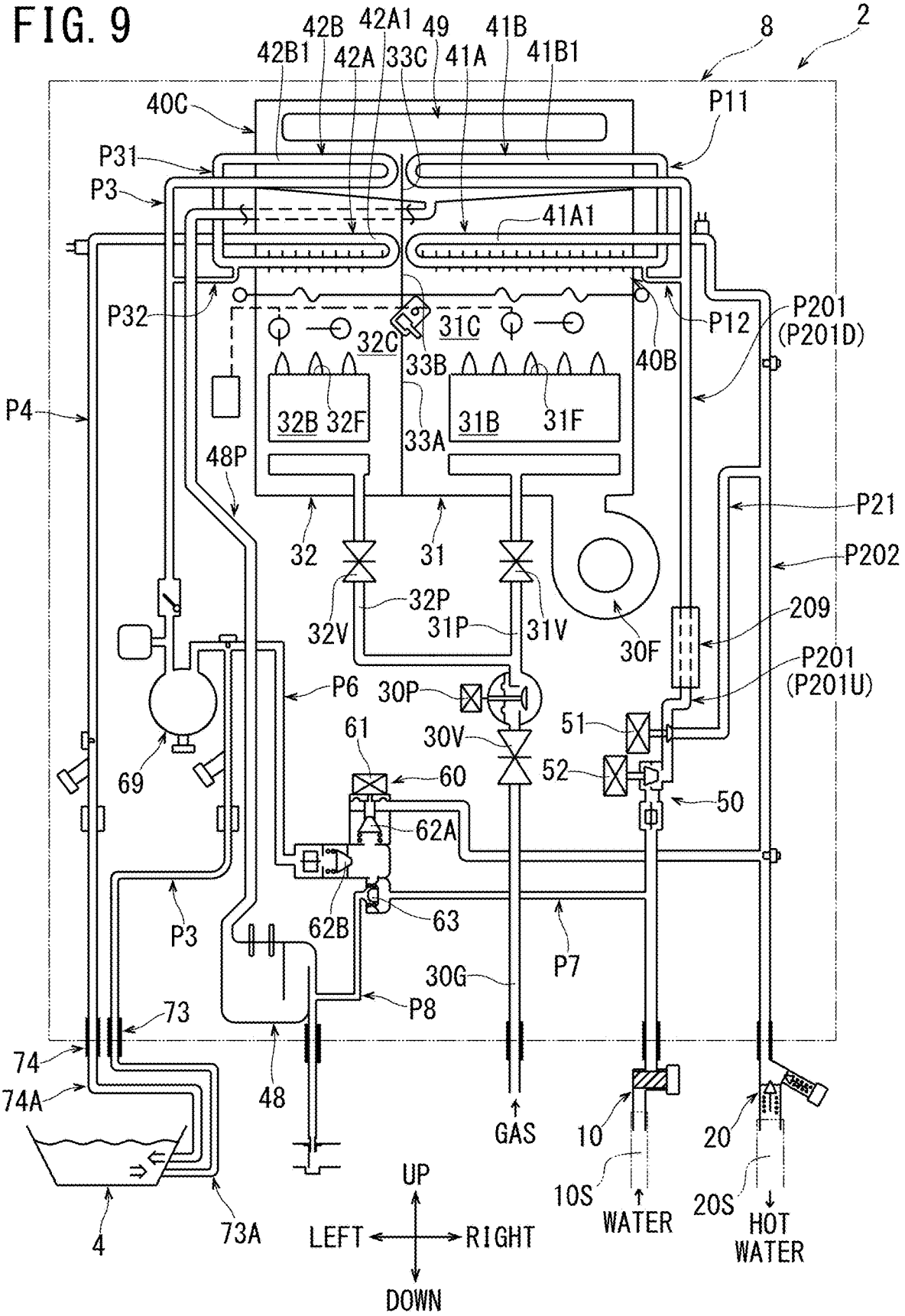
FIG. 9 is a schematic block diagram of a water heater of Working Example 2.
Figure 10:
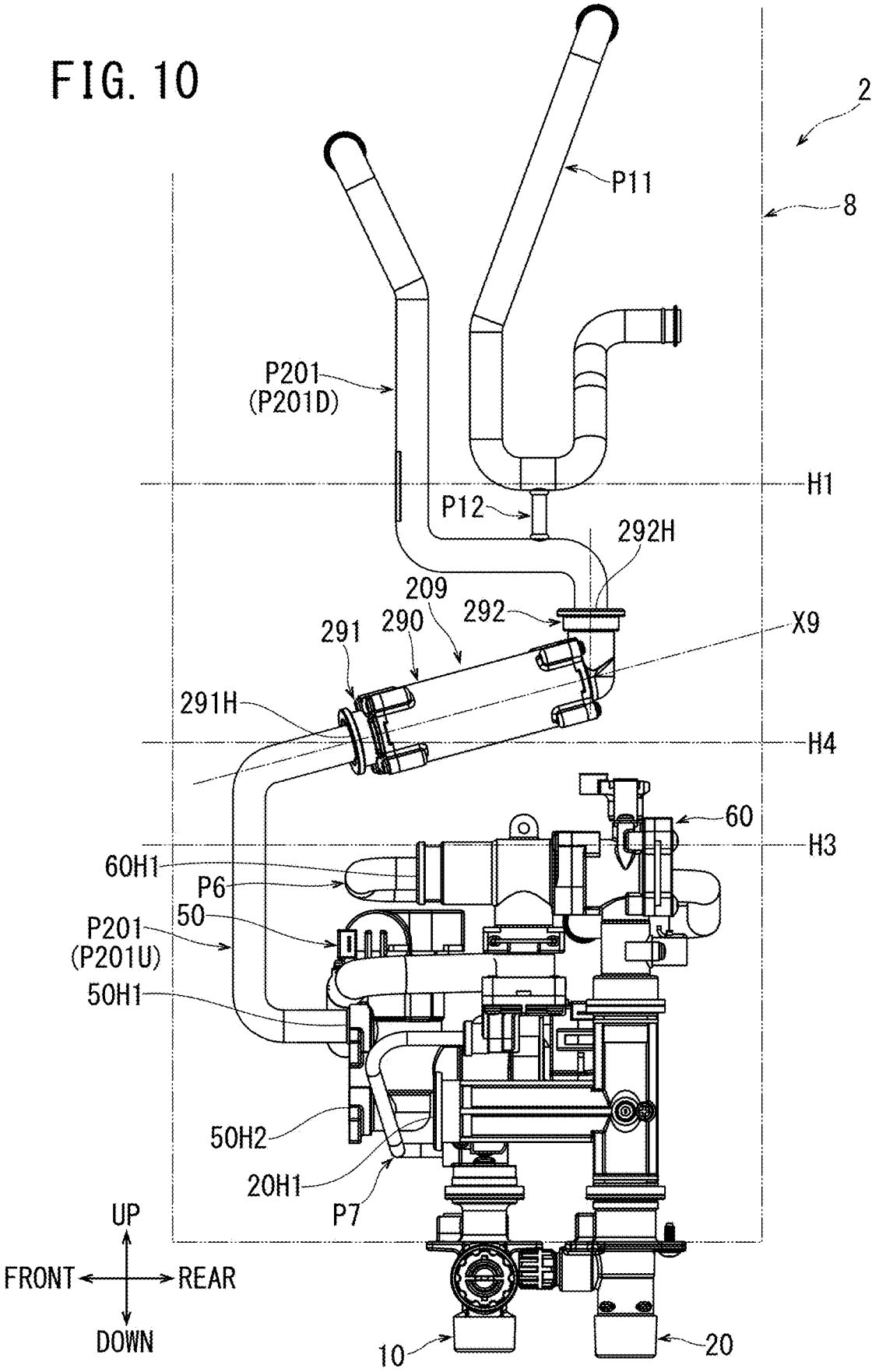

As shown in FIG. 9 and FIG. 10, instead of the water supply pipe P1, the hot water supply pipe P2, and the fine bubble generator 9 as in the water heater 1 of Working Example 1, a water heater 2 of Working Example 2 employs a water supply pipe P201, a hot water supply pipe P202, and a fine bubble generator 209. The water supply pipe P201 is one (another) example of a "specific pipe" of the present teachings.

The configuration of Working Example 2 is otherwise the same as that of Working Example 1. Therefore, for configurations that are identical to those in Working Example 1 identical reference numerals are given, and description is omitted or simplified.

As shown in FIG. 9, in Working Example 2, the fine bubble generator 209 is connected midway along the water supply pipe P201, in the housing 8. The fine bubble generator 209 is located on the first side, which is to say, on the right, of the first main heat exchanger 41A, the first auxiliary heat exchanger 41B, the second main heat exchanger 42A, and the second auxiliary heat exchanger 42B, in the width direction.

In addition, the fine bubble generator 209 is located on the right of the first combustion device 31 and the second combustion device 32, in the width direction.

The only difference that the water supply pipe P201 has with respect to the water supply pipe P1 as in Working Example 1 is that the fine bubble generator 209 is connected midway along the water supply pipe P201. The configuration of the water supply pipe P201 is otherwise the same as that of the water supply pipe P1 as in Working Example 1.

The only difference that the hot water supply pipe P202 has with respect to the hot water supply pipe P2 as in Working Example 1 is that the hot water supply pipe P202 extends uninterruptedly from the upstream end to the downstream end. The configuration of the hot water supply pipe P202 is otherwise the same as that of the hot water supply pipe P2 as in Working Example 1.

As shown in FIG. 10, the fine bubble generator 209 has a main body 290, an inflow part 291, and an outflow part 292, each configured as separate components.

Although illustration is omitted, the only difference that the body part 290 has with respect to the body part 90 as in Working Example 1 is that the orientations of the Venturi member 93 and the stirring members 94 which are incorporated therein are reversed with respect to those in Working Example 1. That is to say, the Venturi member 93 is located on the inflow part 291 side, and the stirring members 94 are each located on the outflow part 292 side. The configuration of the body part 290 is otherwise the same as that of the body part 90 as in Working Example 1.

The inflow part 291 is the same as the outflow part 92 as in Working Example 1. The inflow port 291H of the inflow part 291 is the same as the outflow port 92H as in Working Example 1.

The outflow part 292 is the same as the inflow part 91 as in Working Example 1. The outflow port 292H of the outflow part 292 is the same as the inflow port 92H as in Working Example 1.

The body part 290 is centered on the axis X9, in the same manner as Working Example 1. However, in Working Example 2, one of the axis X9 directions is changed to frontward and the other of the axis X9 directions is changed to rearward.

The body part 290 is connected to the inflow part 291 in one axis X9 direction and connected to the outflow part 292 in the other axis X9 direction.

The fine bubble generator 209 has a substantially tubular shape (substantially cylindrical shape) with a length in the axis X9 direction that is greater than the outer width (outer diameter). The fine bubble generator 209 is connected midway along the water supply pipe P201 with the axis X9 direction inclined. When the fine bubble generator 209 is viewed along the width direction, the axis X9 direction is inclined such that the outflow port 292H is located above the inflow port 291H. In Working Example 2, the axis X9 direction extends substantially parallel to the front-rear direction and the up-down direction.

The inflow port 291H is located frontward of the outflow port 292H. The outflow port 292H is located rearward of the inflow port 291H and opens upward in the vertical direction.

The inflow port 291H is located in one axis X9 direction, which is to say, frontward of the body part 290, and is connected to the upstream side P201U of the water supply pipe P201. Water flows into the inflow port 291H from the upstream side P201U of the water supply pipe P201.

The outflow port 292H is located in the other axis X209 direction, which is to say, rearward of the body part 290, and is connected to the downstream side P201D of the water supply pipe P201. The outflow port 292H allows water including fine bubbles to flow out to the downstream side P201D of the water supply pipe P201.

In FIG. 10, the height of the burner ports 31F, 32F of the burners 31B, 32B is shown by a height H1. The fine bubble generator 209 is located below the burner ports 31F, 32F of the burners 31B, 32B.

In FIG. 10, the height of an upstream side water supply flow path from the water supply connection member 10 to the portion of the upstream side P201U of the water supply pipe P201 that connects to the inflow port 291H is shown by a height H4. The inflow port 291H is located at a height no lower than the height H4 of the upstream side water supply flow path.

In FIG. 10, the height of the internal flow path in the water quantity control part 50 is shown by a height H3. The fine bubble generator 209 is located above the water quantity control part 50 and more specifically above the height H3 of the internal flow path in the water quantity control part 50.

In the same manner as the water heater 1 of Working Example 1, the water heater 2 of Working Example 2, which is thus configured, can output hot water including fine bubbles by way of a hot water supply operation, by way of a hot water filling operation, or the like.

Functions and Effects

In the water heater 2 of Working Example 2, in the same manner as the water heater 1 of Working Example 1, owing to the configuration in which the fine bubble generator 209 accommodated in the housing 8 is located below the burner ports 31F, 32F of the burners 31B, 32B, the need for various measures for curtailing the effects of heat transferred to the fine bubble generator 209 from the first combustion device 31, the second combustion device 32, the first main heat exchanger 41A, the first auxiliary heat exchanger 41B, the second main heat exchanger 42A, and the second auxiliary heat exchanger 42B can be reduced. As a result, this water heater 2 can reduce material costs and work costs for the fine bubble generator 209.

Accordingly, the water heater 2 of Working Example 2 can also avoid manufacturing cost increases in configurations in which the fine bubble generator 209 is accommodated in the housing 8.

In addition, in this water heater 2, the fine bubble generator 209 is located on the first side, which is to say, on the right, of the first main heat exchanger 41A, the first auxiliary heat exchanger 41B, the second main heat exchanger 42A, and the second auxiliary heat exchanger 42B, in the width direction. Owing to this configuration, the fine bubble generator 209 is arranged on the same side as the water supply pipe P201, in the width direction. Therefore, this water heater 2 can avoid the need for an excessive pipe length between the water supply pipe P201 and the fine bubble generator 209, and thus the space within the housing 8 can be used efficiently.

Further, in this water heater 2, the outflow port 292H is located above the inflow port 291H. Furthermore, the inflow port 291H is located at a height no lower than the height H4 of the upstream side water supply flow path from the water supply connection member 10 to the portion of the upstream side P201U of the water supply pipe P201 that connects to the inflow port 291H. Owing to this configuration, the positional relationship in the up-down direction is such that: outflow port 292H>inflow port 291H≥height H4 of the upstream side water supply flow path. Therefore, when draining water from the fine bubble generator 209, this water heater 2 allows water to be drained from the water supply connection member 10, without providing a separate circuit (conduit) for draining water.

In addition, in this water heater 2, the fine bubble generator 209 is located above the water quantity control part 50 and more specifically above the height H3 of the internal flow path in the water quantity control part 50. Owing to this configuration, it is easily possible to touch the water quantity control part 50 or remove the water quantity control part 50 by removing the portion of the water supply pipe P201 that is located on the upstream side relative to the fine bubble generator 209, which is to say, the upstream side P201U of the water supply pipe P201. As a result, this water heater 2 can achieve improvements in ease of maintenance.

Further, in this water heater 2, when the fine bubble generator 209 is viewed along the width direction, the axis X9 direction is inclined such that the outflow port 292H is located above the inflow port 291H. Owing to this configuration, it is possible to suitably achieve an arrangement of the fine bubble generator 209 that is elongated in the axis X9 direction below the burner ports 31F, 32F of the burners 31B, 32B. In addition, because the fine bubble generator 209 is inclined so that the outflow port 292H is located above the inflow port 291H, draining of water in the fine bubble generator 209 can also be performed easily. As a result, this water heater 2 can achieve improved anti-freezing performance.

In addition, in this water heater 2, the outflow port 292H is located rearward of the inflow port 291H and opens upward in the vertical direction. Owing to this configuration, in this water heater 2, the connection between the downstream side P201D of the water supply pipe P201 and the outflow part 292 in which the outflow port 292H is formed can be easily seen from the front, and the connection can be easily touched by reaching a hand through the housing opening 8H. As a result thereof, this water heater 2 can achieve still further improvements in ease of maintenance.

Further, in this water heater 2, the inflow port 291H is located frontward of the outflow port 292H. From the viewpoint of ease of assembly operations, the water supply connection port 50H1 of the water quantity control part 50, to which the upstream end of the water supply pipe P201 is connected, often opens toward the front side of the housing 8, which is also the case in Working Example 2. Therefore, owing to the configuration in which the inflow port 291H is located frontward of the outflow port 292H, it is possible to smoothly route the upstream side P201U of the water supply pipe P201, which connects to the inflow port 291H, to the water supply connection port 50H1 of the water quantity control part 50. As a result, this water heater 2 can achieve improvements in ease of assembly operations and ease of work, and reductions in manufacturing costs.

Aspects of the present teachings have been described above based on Working Examples 1 and 2, but the present invention is not limited to Working Examples 1 and 2 described above and, needless to say, modifications may be effected as appropriate within a scope that does not depart from the spirit of the present invention.

Configurations in which the second combustion device 32, the second main heat exchanger 42A, the second auxiliary heat exchanger 42B, the hot water filling water control part 60, the bath return pipe P3, the intermediate pipe P31, the bath feed pipe P4, the pump 69, and the like, for the bath, are eliminated from Working Examples 1 and 2, which is to say, single-function water heaters, are also included in the present teachings.

In Working Examples 1 and 2, the fine bubble generator 9, 209 is located on the first side, which is to say, on the right, of the first main heat exchanger 41A, the first auxiliary heat exchanger 41B, the second main heat exchanger 42A, and the second auxiliary heat exchanger 42B, in the width direction, but the present teachings are not limited to this configuration. For example, as long as the fine bubble generator is located below the burner ports of the burners, the fine bubble generator may be located on the second side, that is the other side, at the front, at the rear, or under the heat exchangers.

In Working Examples 1 and 2, the fuel for the first combustion device 31 and the second combustion device 32 is a fuel gas such as city gas (methane) or propane gas, but the present teachings are not limited to this configuration. For example, the fuel for the combustion devices may be a liquid, such as kerosene.

In Working Example 1, the inflow port 91H is located rearward of the outflow port 92H and opens upward in the vertical (up-down) direction, but the present teachings are not limited to this configuration. For example, the present teachings also include a configuration in which the orientation of the fine bubble generator 9 as in the water heater 1 in Working Example 1 is changed so that the outflow port 92H is located rearward of the inflow port 91H and opens downward in the vertical direction. According to the water heater in such a modified embodiment, the connection between the downstream side P2D of the hot water supply pipe P2 and the outflow port 92H can be easily seen from the front, and can also be easily touched by reaching a hand through the housing opening 8H, and thus still further improvements in ease of maintenance can be achieved.

In Working Example 2, the outflow port 292H is located rearward of the inflow port 291H and opens upward in the vertical (up-down) direction, but the present teachings are not limited to this configuration. For example, the present teachings also include a configuration in which the orientation of the fine bubble generator 209 as in the water heater 2 in Working Example 2 is changed so that the inflow port 291H is located rearward of the outflow port 292H and opens downward in the vertical direction. According to the water heater in such a modified embodiment, the connection between the upstream side P201U of the water supply pipe P201 and the inflow port 291H can be easily seen from the front, and can also be easily touched by reaching a hand through the housing opening 8H, and thus still further improvements in ease of maintenance can be achieved.

In Working Examples 1 and 2, the water quantity control part 50 has a bypass servo 51 and a water quantity servo 52, but the present teachings are not limited to this configuration. The water quantity control part can be configured in any manner so long as it allows the flow rate of the water flowing through the water supply pipe to be controlled and, for example, the present teachings also include configurations in which the water quantity control part has only one of the bypass servo and the water quantity servo.

In Working Examples 1 and 2, the fine bubble generators 9, 209 have a substantially cylindrical shape in which the length in the axis X9 direction is greater than the outer diameter, but the present teachings are not limited to this configuration. For example, so long as the length of the fine bubble generator in the axial direction is greater than the outer width, the fine bubble generator may have a substantially tubular shape, such as that of a square tube, a polygonal tube, or the like.

In Working Examples 1 and 2, the axis X9 direction extends substantially parallel to the front-rear direction and the up-down direction, but the present teachings are not limited to this configuration. For example, the axial direction may be inclined with respect to the front-rear direction and the up-down direction.

INDUSTRIAL APPLICABILITY

The present teachings can be used, for example, for a water heater that has only a hot water supply function, a water heater that has a hot water supply function and a bath reheating function, a water heater/space heater that has a hot water supply function and a function of circulating hot water to and from a space heating unit, and the like.

EXPLANATION OF THE REFERENCE NUMERALS

1, 2: water heater
8A: housing body
8H: housing opening
8B: front plate
8: housing
31C, 32C: combustion chamber
31B, 32B: burner
31F, 32F: burner ports of burner
31, 32: combustion device (31 first combustion device; 32 second combustion device)
41A, 41B, 42A, 42B: heat exchanger (41A: first main heat exchanger, 41B: first auxiliary heat exchanger, 42A: second main heat exchanger, 42B: second auxiliary heat exchanger)
P1, P201: water supply pipe
P201U: upstream side of water supply pipe
P201D: downstream side of water supply pipe
P2, P202: hot water supply pipe
P2U: upstream side of hot water supply pipe
P2D: downstream side of hot water supply pipe
10S: water supply path
10: water supply connection member
20S: hot water supply path
20: hot water supply connection member
50: water quantity control part
9, 209: fine bubble generator
X9: axis
91H, 291H: inflow port
92H, 292H: outflow port
91, 291: inflow part
92, 292: outflow part
90, 290: body part

The invention claimed is:

1. A water heater comprising:

a housing having a substantially box-shaped housing body that is recessed toward a rear side in a front-rear direction and has a housing opening that opens on a front side in the front-rear direction, and a front plate that covers the housing opening;

a combustion device, accommodated in the housing, which has a combustion chamber and a burner with one or more burner ports located in the combustion chamber, the combustion device being configured to generate a high-temperature gas;

a heat exchanger, accommodated above the combustion chamber in the housing in an up-down direction that is orthogonal to the front-rear direction, the heat exchanger being configured to heat water passing through the interior thereof using the high-temperature gas;

a water supply pipe, accommodated in the housing, located on a first side of the heat exchanger in a width direction that orthogonally intersects the front-rear direction and the up-down direction, and extending in the up-down direction, the water supply pipe being fluidly connected to the heat exchanger;

a hot water supply pipe, accommodated in the housing, located on the first side of the heat exchanger in the width direction, and extending in the up-down direction, the hot water supply pipe being fluidly connected to the heat exchanger;

a water supply connection member, located on an underside of the housing body, the water supply connection member being configured to fluidly connect the water supply pipe to a water supply path that is outside the housing;

a hot water supply connection member, located on the underside of the housing body, the hot water supply connection member being configured to fluidly connect the hot water supply pipe to a hot water supply path that is outside the housing;

a water quantity control part fluidly disposed between the water supply connection member and the water supply pipe, and configured to control the flow rate of water flowing through the water supply pipe; and a fine bubble generator, accommodated in the housing, which is fluidly connected to a specific pipe that is either the water supply pipe or the hot water supply pipe, the fine bubble generator having a substantially tubular shape with a length in the axial direction that is greater than an outer width of the fine bubble generator, and being configured to cause fine bubbles to be generated in hot water that flows by simply flowing the hot water through the interior thereof;

wherein the fine bubble generator has an inflow port, located in one axial direction, into which the hot water flows from the upstream side of the specific pipe, and an outflow port, located in the other axial direction, out of which the hot water containing the fine bubbles is discharged to the downstream side of the specific pipe, and the inflow port and the outflow port of the fine bubble generator are located below the burner port(s) in the up-down direction.

2. The water heater according to claim 1, wherein the fine bubble generator is located on the first side of the heat exchanger in the width direction.

3. The water heater according to claim 2, wherein the inflow port and the outflow port of the fine bubble generator are located above the water quantity control part in the up-down direction.

4. The water heater according to claim 2, wherein one of the inflow port and the outflow port is located rearward of the other of the inflow port and the outflow port.

5. The water heater according to claim 4, wherein said one of the inflow port and the outflow port opens in the up-down direction.

6. The water heater according to claim 1, wherein:

the specific pipe is the hot water supply pipe;

the inflow port is located above the outflow port in the up-down direction; and the outflow port is located at a height in the up-down direction that is no lower than a downstream side hot water supply flow path from a portion of the hot water supply pipe, which connects to the outflow port, to the hot water supply connection member.

7. The water heater according to claim 1, wherein the axial direction is inclined with respect to the up-down direction.

8. The water heater according to claim 7, wherein a first angle between the upstream side of the specific pipe and the fine bubble generator and/or a second angle between the fine bubble generator and the downstream side of the specific pipe is (are) an obtuse angle.

9. The water heater according to claim 7, wherein:

the specific pipe is the water supply pipe; and a portion of the water supply pipe is located below the burner port(s) and directly above the fine bubble generator in the up-down direction.

10. The water heater according to claim 9, wherein the portion of the water supply pipe includes a horizontally extending portion.

11. The water heater according to claim 1, wherein:

the specific pipe is the water supply pipe;

the outflow port is located above the inflow port in the up-down direction; and the inflow port is located at a height in the up-down direction that is no lower than an upstream side water supply flow path from the water supply connection member to a portion of the water supply pipe that connects to the inflow port.

12. The water heater according to claim 1, wherein the fine bubble generator has:

an inflow part, in which the inflow port is formed, that fluidly connects to an upstream side of the specific pipe;

an outflow part, in which the outflow port is formed, that fluidly connects to a downstream side of the specific pipe; and a body part, fluidly connected to the inflow part in the one axial direction and fluidly connected to the outflow part in the other axial direction, the body part being configured to cause the fine bubbles to be generated in the hot water that flows through the interior thereof, the inflow part, the outflow part, and the body part are each separate components, and the inflow part and the outflow part are affixed to opposite ends of the body part.

13. The water heater according to claim 1, wherein the fine bubble generator is configured to generate the fine bubbles from air that is dissolved in the hot water.

14. The water heater according to claim 1, wherein:

the specific pipe is the hot water supply pipe; and a portion of the water supply pipe is located below the burner port(s) and directly above the fine bubble generator in the up-down direction.

* * * * *